US009869435B2

(12) United States Patent
DeCarr et al.

(10) Patent No.: US 9,869,435 B2
(45) Date of Patent: Jan. 16, 2018

(54) MODULAR LIGHT FIXTURES

(71) Applicants: Graig DeCarr, Cicero, NY (US); Alvah Aldrich, Geneva, NY (US); Jonathan Jay Skellham, Verona, NY (US); Natesha Sanjeeve Gowda Gangoor, Hassan (IN); Pradeep Bangalore Venugopal, Bengaluru (IN); Vinod Manohar Shet, Bengaluru (IN)

(72) Inventors: Graig DeCarr, Cicero, NY (US); Alvah Aldrich, Geneva, NY (US); Jonathan Jay Skellham, Verona, NY (US); Natesha Sanjeeve Gowda Gangoor, Hassan (IN); Pradeep Bangalore Venugopal, Bengaluru (IN); Vinod Manohar Shet, Bengaluru (IN)

(73) Assignee: Cooper Technologies Company, Houston, TX (US)

( * ) Notice: Subject to any disclaimer, the term of this patent is extended or adjusted under 35 U.S.C. 154(b) by 219 days.

(21) Appl. No.: 14/693,702

(22) Filed: Apr. 22, 2015

(65) Prior Publication Data

US 2015/0300610 A1 Oct. 22, 2015

Related U.S. Application Data

(60) Provisional application No. 61/982,803, filed on Apr. 22, 2014.

(51) Int. Cl.
*F21S 8/06* (2006.01)
*F21V 15/01* (2006.01)
(Continued)

(52) U.S. Cl.
CPC ..... *F21S 8/061* (2013.01); *F21V 15/01* (2013.01); *F21V 15/02* (2013.01); *F21S 2/005* (2013.01);
(Continued)

(58) Field of Classification Search
CPC ..... F21S 8/061; F21S 2/005; F21V 15/01; F21V 15/02; F21V 29/507; F21V 29/763;
(Continued)

(56) References Cited

U.S. PATENT DOCUMENTS 6,422,716 B2 7/2002 Henrici et al.
6,966,704 B2 11/2005 Ikeda et al.
(Continued)

FOREIGN PATENT DOCUMENTS

CN 101818873 9/2010
EP 2525136 11/2012
RU 2313199 12/2007

OTHER PUBLICATIONS

M. Trofimova, International Search Report and Written Opinion issue in International Application No. PCT/US2015/027137, completion date Jul. 11, 2016, dated Aug. 18, 2016, 8 pages.
(Continued)

*Primary Examiner* — Mary Ellen Bowman
(74) *Attorney, Agent, or Firm* — King & Spalding LLP

(57) ABSTRACT

A modular light fixture is described herein. The light fixture can include a frame having at least one light module coupling device, where the at least one light module coupling device includes at least one light module coupling feature. The light fixture can also include at least one light module coupled to the frame, where the at least one light module includes at least one frame coupling feature that couples to the at least one light module coupling feature of the at least one light module coupling device.

20 Claims, 22 Drawing Sheets

(51) Int. Cl.

| | |
|---|---|
| ***F21V 15/02*** | (2006.01) |
| *F21S 2/00* | (2016.01) |
| *F21V 23/02* | (2006.01) |
| *F21Y 113/00* | (2016.01) |
| *F21V 29/507* | (2015.01) |
| *F21V 29/76* | (2015.01) |
| *F21Y 105/10* | (2016.01) |
| *F21Y 115/10* | (2016.01) |

(52) U.S. Cl.
CPC ..... *F21V 23/023* (2013.01); *F21V 29/507* (2015.01); *F21V 29/763* (2015.01); *F21Y 2105/10* (2016.08); *F21Y 2113/00* (2013.01); *F21Y 2115/10* (2016.08)

(58) Field of Classification Search
CPC ..... F21V 23/023; F21Y 2105/10; F21Y 2115/10; F21Y 2101/00; F21Y 2113/00
See application file for complete search history.

(56) References Cited

U.S. PATENT DOCUMENTS

| | | | |
|---|---|---|---|
| 7,513,639 | B2 | 4/2009 | Wang |
| 7,654,691 | B2 | 2/2010 | Liu et al. |
| 7,703,941 | B2 | 4/2010 | Lee |
| 7,742,306 | B2 | 6/2010 | Shuai et al. |
| 7,771,087 | B2 | 8/2010 | Wilcox et al. |
| 7,841,740 | B2 | 11/2010 | Zhou et al. |
| 7,891,845 | B2 | 2/2011 | Zhang et al. |
| 7,891,847 | B2 | 2/2011 | Vukosic et al. |
| 7,950,828 | B2 | 5/2011 | Zhang et al. |
| 7,952,262 | B2 | 5/2011 | Wilcox et al. |
| 7,963,669 | B2 | 6/2011 | Hockel et al. |
| 7,988,331 | B2 | 8/2011 | Zheng |
| 8,066,404 | B2 | 11/2011 | Song et al. |
| 8,070,306 | B2 | 12/2011 | Ruud et al. |
| 8,070,317 | B2 | 12/2011 | Zhang et al. |
| 8,087,807 | B2 | 1/2012 | Liu et al. |
| 8,157,420 | B2 | 4/2012 | Song et al. |
| 8,203,166 | B2 | 6/2012 | Chin |
| 8,231,261 | B2 | 7/2012 | Gherardini et al. |
| 8,267,544 | B2 | 9/2012 | Zheng et al. |
| 8,308,320 | B2 | 11/2012 | Tickner et al. |
| 8,308,324 | B2 | 11/2012 | Van Horn et al. |
| 8,313,222 | B2 | 11/2012 | Kinnune et al. |
| 8,419,216 | B2 | 4/2013 | Wu |
| 8,444,298 | B2 | 5/2013 | Lin et al. |
| 8,690,381 | B2 | 4/2014 | Yu |
| 8,702,278 | B2 | 4/2014 | Wang et al. |
| 8,764,220 | B2 | 7/2014 | Chan et al. |
| 8,794,795 | B2 | 8/2014 | Yaphe et al. |
| 8,845,116 | B2 | 9/2014 | Kim et al. |
| 8,864,347 | B2 | 10/2014 | Pearson et al. |
| 2009/0002669 | A1 | 1/2009 | Liu et al. |
| 2009/0196037 | A1 | 8/2009 | Xiao et al. |
| 2012/0127702 | A1 | 5/2012 | Lax et al. |
| 2012/0218758 | A1 | 8/2012 | Wang et al. |
| 2013/0027937 | A1 | 1/2013 | Winters |
| 2013/0163234 | A1 | 6/2013 | Hsien et al. |
| 2013/0163235 | A1 | 6/2013 | Chuang |
| 2013/0301256 | A1 | 11/2013 | Thomas et al. |
| 2013/0301264 | A1 | 11/2013 | Van Gompel |
| 2014/0078740 | A1 | 3/2014 | Kinnune et al. |
| 2014/0160758 | A1 | 6/2014 | Sheu |
| 2014/0233232 | A1 | 8/2014 | Radermacher |
| 2014/0268773 | A1 | 9/2014 | DeKeyser |
| 2014/0299893 | A1 | 10/2014 | Weng |
| 2014/0307438 | A1 | 10/2014 | Pearson et al. |
| 2014/0334149 | A1 | 11/2014 | Nolan et al. |

OTHER PUBLICATIONS

Machine Translation of CN 101818873A, via LexisNexis Total Patent, 6 pages.
Machine Translation of RU 2313199, via LexisNexis Total Patent, 7 pages.

MODULAR LIGHT FIXTURES

CROSS-REFERENCE TO RELATED APPLICATIONS

This application claims priority under 35 U.S.C. §119 to U.S. Provisional Patent Application Ser. No. 61/982,803, titled "Industrial High Bay Light Fixture" and filed on Apr. 22, 2014, the entire contents of which are hereby incorporated herein by reference.

TECHNICAL FIELD

Embodiments described herein relate generally to light fixtures, and more particularly to systems, methods, and devices for modular light fixtures that can be expanded or reduced in size.

BACKGROUND

In certain applications, the size and shape of a light fixture for a particular application can vary. For example, an industrial high bay (IHB) light fixture is commonly used in warehouses, assembly plants, and similar environments that have very high ceilings and vast open spaces. The preferences of a user can also vary. Thus, a light fixture of a certain shape and size may be effective to use in a certain application, but the user of that light fixture may have more preferable shapes and/or sizes for that application.

SUMMARY

In general, in one aspect, the disclosure relates to a modular light fixture. The modular light fixture can include a frame having at least one light module coupling device, where the at least one light module coupling device includes at least one light module coupling feature. The modular light fixture can also include at least one light module coupled to the frame, where the at least one light module includes at least one frame coupling feature that couples to the at least one light module coupling feature of the at least one light module coupling device.

In another aspect, the disclosure can generally relate to a light module for a modular light fixture. The light module can include a body having a length and a width, where the width defines a first end and a second end of the body, and where the length defines a first side and a second side of the body. The light module can also include a first frame coupling feature disposed at the first end of the body, where the first frame coupling feature is configured to couple to a first light module coupling feature of a frame of the modular light fixture.

In yet another aspect, the disclosure can generally relate to a frame for a modular light fixture. The frame can include at least one wall. The frame can also include at least one light module coupling device disposed on the at least one wall, where the at least one light module coupling device includes at least one light module coupling feature and is configured to couple to a frame coupling feature of at least one light module of the modular light fixture.

These and other aspects, objects, features, and embodiments will be apparent from the following description and the appended claims.

BRIEF DESCRIPTION OF THE DRAWINGS

The drawings illustrate only example embodiments of modular light fixtures and are therefore not to be considered limiting of its scope, as modular light fixtures may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
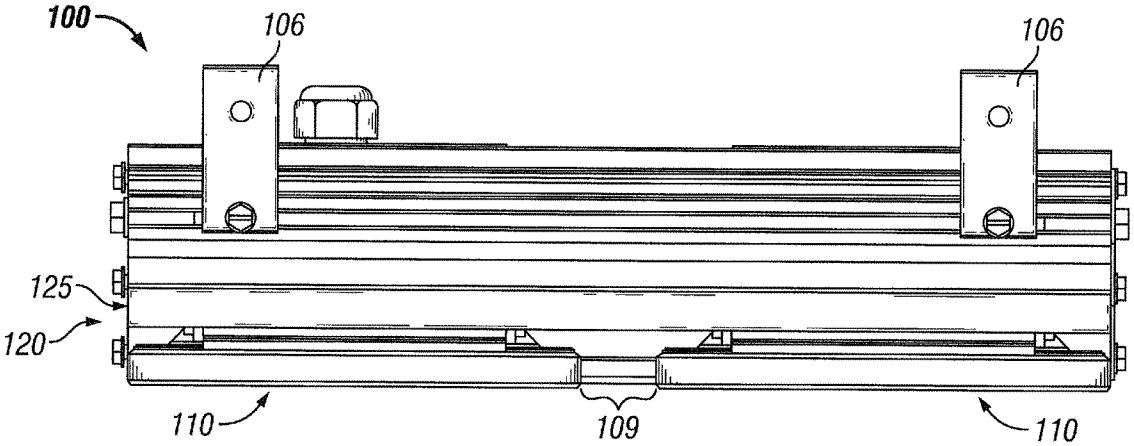
FIGS. 1A-1D show various views of an example modular light fixture in accordance with certain example embodiments.

The example embodiments discussed herein are directed to systems, apparatuses, and methods for modular light fixtures. Such modular light fixtures (or components thereof, such as light modules of a modular light fixture) can use any one or more of a number of lighting technologies. For example, a light module can have one or more of a number of types of socket into which one or more light sources are electrically and mechanically coupled. Examples of types of sockets can include, but are not limited to, an Edison screw base of any diameter (e.g., E26, E12, E 14, E39), a bayonet style base, a bi-post base, a bi-pin connector base, a wedge base, a terminal block, and a fluorescent tube base. A light source of an example modular light fixture can electrically and mechanically couple to the socket and can be of a light source type that corresponds to the type of socket.

Examples of light source types of the light source can include, but are not limited to, light-emitting diodes (LEDs), incandescent lamps, halogen lamps, G10/GU10, G9/GU9, AR111/PAR36, T3, MR-11, and MR-16. If the light source of a modular light fixture (including any portion thereof) is a LED, the LED can be of one or more of a number of types of LED technology, including but not limited to discrete LEDs, LED arrays, chip-on-board LEDs, edge lit LED panels, and surface mounted LEDs.

An example modular light fixture (also more simply called a light fixture herein) can be mounted in any of a number of locations and/or be used in any of a number of applications. For example, modular light fixtures described herein can be used as industrial high bay light fixtures in warehouse, assembly plant, power plant, chemical plant, and/or any such similar applications. A modular light fixture can be electrically coupled to a power source to provide power and/or control to the modular light fixture. The power source can provide the modular light fixture with one or more of a number (and/or a range) of voltages, including but not limited to 120 V alternating current (AC), 110 VAC, 240 VAC, 24 V direct current (DC), and 0-10 VDC.

Due in part to the modular aspect described herein, such modular light fixtures can be of any size and/or shape, and can have any number of light modules. Such modular light fixtures can be located indoor and/or outdoors and can be mounted to a surface (e.g., cabinet, wall, ceiling, pillar), be part of a lamp, or be used with any other suitable mounting instrument. Such modular light fixtures can be used in residential, commercial, and/or industrial applications. Such modular light fixtures can operate from a manual fixture (e.g., on/off switch, dimming switch, pull chain), a sensor (e.g., a photocell, a motion detector), a timer, and/or any other suitable mechanism.

Any components (e.g., frame) of example modular light fixtures, or portions thereof, described herein can be made from a single piece (as from a mold, injection mold, die cast, or extrusion process). In addition, or in the alternative, a component (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling. In addition, each component and/or feature described herein (including each component of an example modular light fixture) can be made of one or more of a number of suitable materials, including but not limited to metal, ceramic, rubber, and plastic.

A coupling feature (including a complementary coupling feature) as described herein can allow one or more components and/or portions of a modular light fixture (e.g., a light module) to become mechanically and/or electrically coupled, directly or indirectly, to another portion (e.g., a frame) of the modular light fixture. A coupling feature can include, but is not limited to, a clamp, a portion of a hinge, an aperture, a recessed area, a protrusion, a slot, a spring clip, a tab, a detent, and mating threads. One portion of an example modular light fixture can be coupled to another portion of the modular light fixture by the direct use of one or more coupling features.

In addition, or in the alternative, a portion of an example modular light fixture can be coupled to another portion of the modular light fixture using one or more independent devices that interact with one or more coupling features disposed on a component of the modular light fixture. Examples of such devices can include, but are not limited to, a pin, a hinge, a fastening device (e.g., a bolt, a screw, a rivet), and a spring. One coupling feature described herein can be the same as, or different than, one or more other coupling features described herein. A complementary coupling feature as described herein can be a coupling feature that mechanically couples, directly or indirectly, with another coupling feature.

In certain example embodiments, the modular light fixtures (or portions thereof) described herein meet one or more of a number of standards, codes, regulations, and/or other requirements established and maintained by one or more entities. Examples of such entities include, but are not limited to, Underwriters' Laboratories (UL), the National Electric Code (NEC), and the Institute of Electrical and Electronics Engineers (IEEE). For example, UL may require that an example modular light fixture used as a high bay light fixture be suitable for operation in damp environments.

As described herein, a user can be any person that interacts with example modular light fixtures. Examples of a user may include, but are not limited to, a consumer, an electrician, an engineer, a mechanic, a home owner, a business owner, a consultant, a contractor, an operator, and a manufacturer's representative. For any figure shown and described herein, one or more of the components may be omitted, added, repeated, and/or substituted. Accordingly, embodiments shown in a particular figure should not be considered limited to the specific arrangements of components shown in such figure.

Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three or four digit number and corresponding components in other figures have the identical last two digits.

Example embodiments of modular light fixtures will be described more fully hereinafter with reference to the accompanying drawings, in which example embodiments of modular light fixtures are shown. Modular light fixtures may, however, be embodied in many different forms and should not be construed as limited to the example embodiments set forth herein. Rather, these example embodiments are provided so that this disclosure will be thorough and complete, and will fully convey the scope of modular light fixtures to those of ordinary skill in the art. Like, but not necessarily the same, elements (also sometimes called components) in the various figures are denoted by like reference numerals for consistency.

Terms such as "first", "second", "third", "height", "width", "length" "distal", "top", "bottom", "side", "left", and "right" are used merely to distinguish one component (or part of a component or state of a component) from another. Such terms are not meant to denote a preference or a particular orientation, and are not meant to limit embodiments of modular light fixtures. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
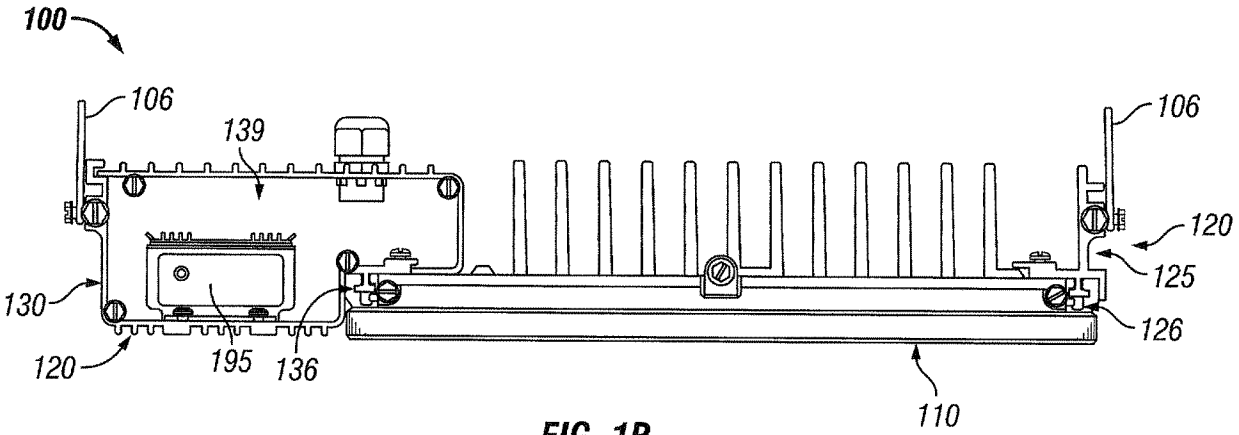
Figure 1C:
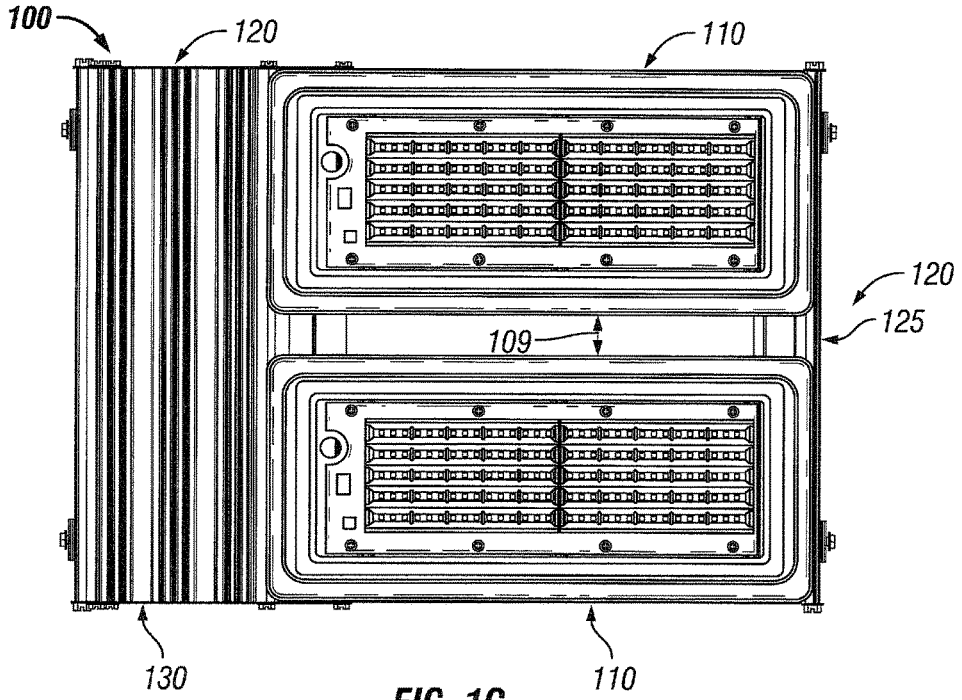
Figure 1D:
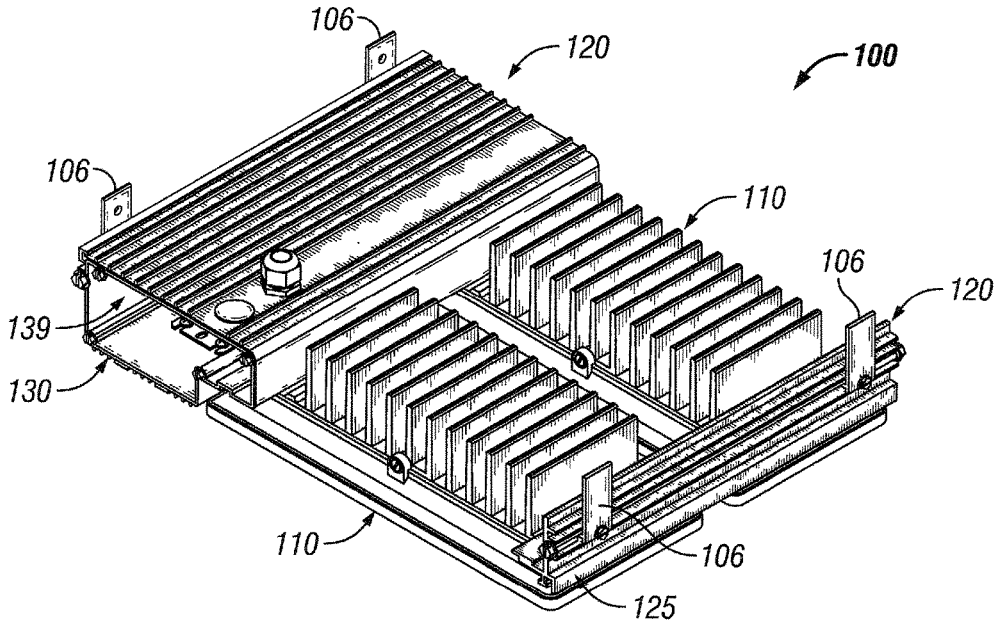

FIGS. 1A-1D show various views of an example modular light fixture 100 in accordance with certain example embodiments. Specifically, FIG. 1A shows a front view of the modular light fixture 100. FIG. 1B shows a cross-sectional side view of the modular light fixture 100. FIG. 1C shows a bottom view of the modular light fixture 100. FIG. 1D shows a bottom-side perspective view of the modular light fixture 100. The example modular light fixture 100 includes a frame 120 and at least one light module 110 coupled to the frame 120.

Figure 8:
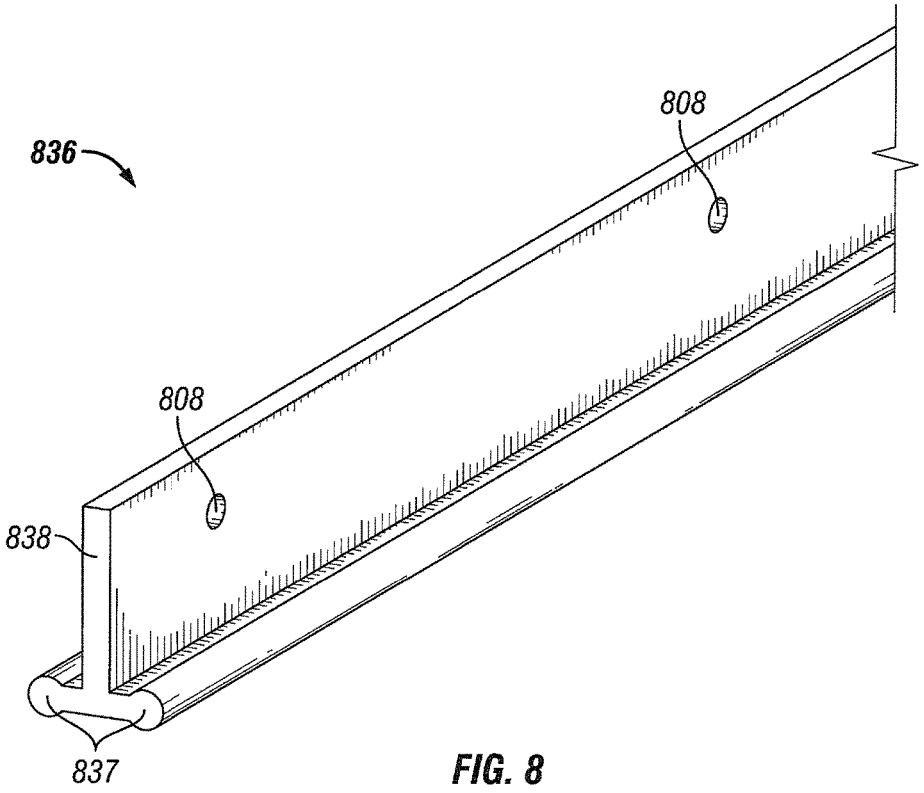
FIG. 8 shows a light module coupling device in accordance with certain example embodiments.

In certain example embodiments, the frame 120 includes one or more light module coupling devices (e.g., light module coupling device 126, light module coupling device 136) that are used to couple one or more (in this case, two) light modules 110 to the frame 120. Each light module coupling device can be a separate component that couples to the frame 120 (as shown in FIGS. 8-9B below). Alternatively, as shown in FIGS. 1A-1D, each light module coupling device can be integrated with one or more portions or components of the frame 120. Each light module coupling device can include one or more features that couple, directly or indirectly, to a frame coupling feature (described below) of one or more light modules 110. Details of the light module coupling devices of FIGS. 1A-1D are provided below with respect to FIGS. 4 and 5.

The frame 120 can have any characteristics (e.g., shape, size, contours) suitable for the application and environment of the modular light fixture 100. In addition, the frame 120 can have any of a number of components. In this example, the frame 120 includes a housing 130 and a connecting bracket 125 that are not directly coupled to each other. The housing 130 has one light module coupling device 136, and the connecting bracket 125 has another light module coupling device 126. Each of the light module coupling device 136 and the light module coupling device 126 can couple to one or more light modules 110. The housing 130 and/or the connecting bracket 125 can also include one or more of a number of other coupling features (e.g., apertures in this case) that allow the frame 120 to couple, directly or indirectly, to one or more other components (e.g., a light module) of the modular light fixture 100.

In addition, or in the alternative, the housing 130 and/or the connecting bracket 125 can include one or more coupling features (e.g., apertures in this case) that allow the housing 130 and/or the connecting bracket 125 to couple, directly or indirectly, to one or more mounting devices 106. In such a case, each mounting device 106 can be used to mount the modular light fixture 100 within a space (e.g., a warehouse, an assembly plant).

In certain example embodiments, the frame 120 can include one or more of a number of other components that are used to operate the light modules 110 coupled to the frame 120. Examples of such other components can include, but are not limited to, a power source, an electrical conductor, a terminal block, a controller, a discrete component (e.g., capacitor, resistor, inductor, diode), a heat sink, and a charge transfer device (e.g., a transformer, an inductor, a converter). Each of these components can be disposed on or in any portion of the frame 120. In addition, or in the alternative, one or more of these other components can be disposed in or on one or more of the light modules 110. For example, as shown in FIGS. 1A-1D, the housing 130 of the frame 120 can form a cavity 139.

Among other components, a light fixture 100 can include at least one power source 195. The power source 195 (e.g., a LED driver, a ballast) can be used to provide power and/or control signals to one or more light modules 110. As shown in FIG. 1B, a power source 195 can be disposed within the cavity 139 of the housing 130. In addition, or in the alternative, a power source 195 can be part of a light module 110. In addition, or in the alternative, a power source 195 can be located remotely from the light fixture 100. In such a case, such power source 195 would not be included in the one or more light modules 110 and/or the frame 120 of the light fixture 100.

When the light modules 110 are coupled to the frame 120, there can be an air gap 109 between two adjacent light modules 110. The distance of the air gap 109 can vary (as by a user) between adjacent light modules 110 in the light fixture 100. Alternatively, the distance of the air gap 109 can be fixed (for example, based on detents in the frame 120 to fix where the light modules 110 are disposed with respect to the frame 120 and each other). The air gap 109 can serve one or more of a number of purposes. For example, the air gap 109 can be used to help air (e.g., ambient air) circulate around thermally-conductive components (e.g., heat sink) that absorb heat generated by heat-generating components (e.g., light source, power source) of the modular light fixture 100. Thus, in such a case, the air gap 109 helps to keep one or more components of the modular light fixture 100 from overheating, which can cause failure or deterioration of the modular light fixture 100.

Figure 2A:
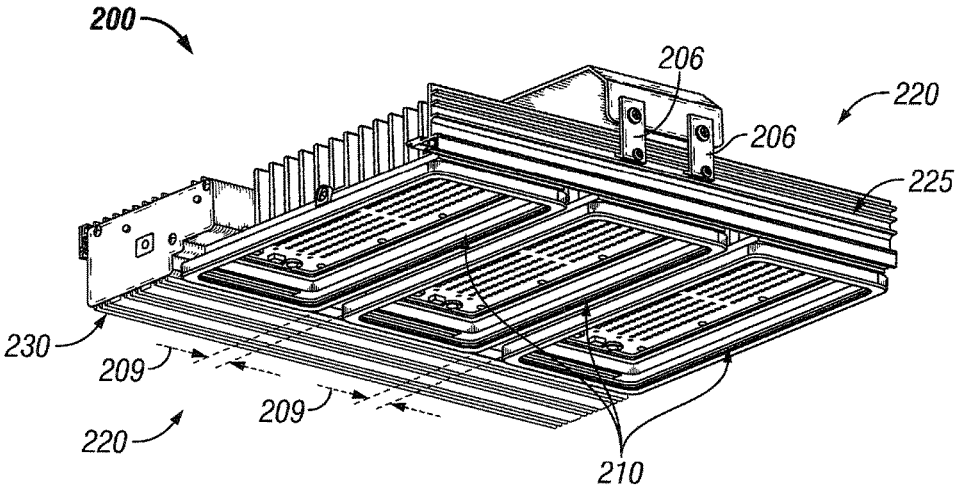
FIGS. 2A and 2B show various views of another modular light fixture in accordance with certain example embodiments.
Figure 2B:
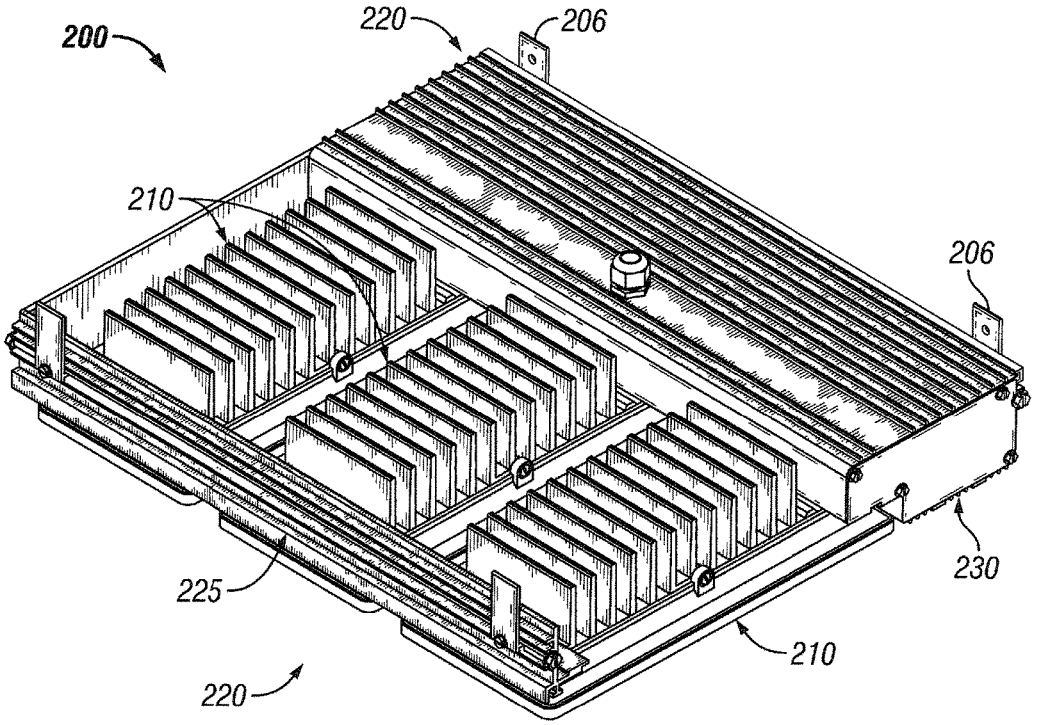

FIGS. 2A and 2B show various views of another modular light fixture 200 in accordance with certain example embodiments. Specifically, FIG. 2A shows a bottom-side perspective view of the modular light fixture 200. FIG. 2B shows a top-side perspective view of the modular light fixture 200. The modular light fixture 200 of FIGS. 2A and 2B is substantially the same as the modular light fixture 100 of FIGS. 1A-1D, except that the modular light fixture 200 has three light modules 210. As a result, there are two air gaps 209 between the light modules 210. The distance of one air gap 209 can be substantially the same as, or different than, the distance of the other air gap 209.

Figure 3A:
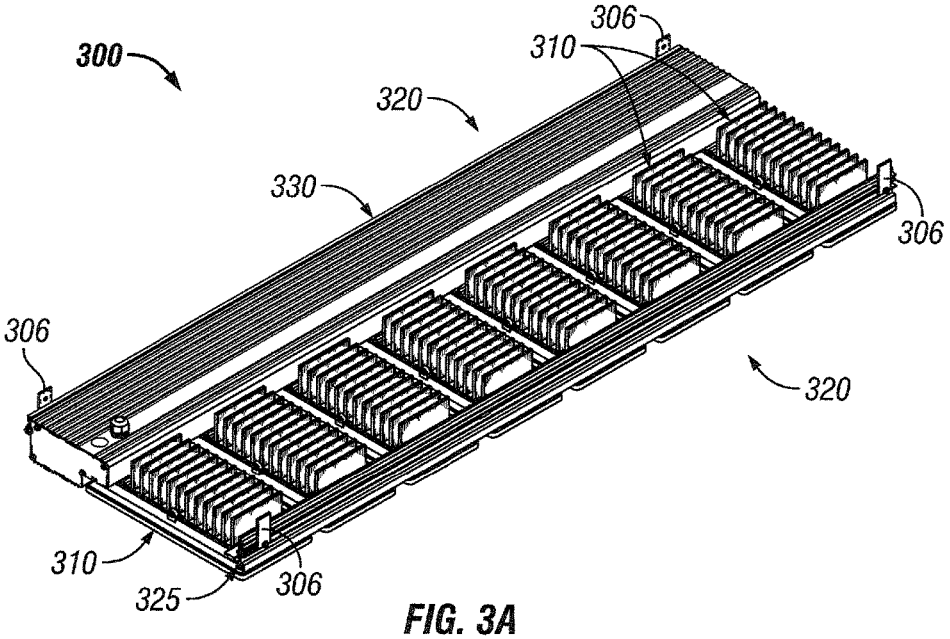
FIGS. 3A and 3B show various views of yet another modular light fixture in accordance with certain example embodiments.
Figure 3B:
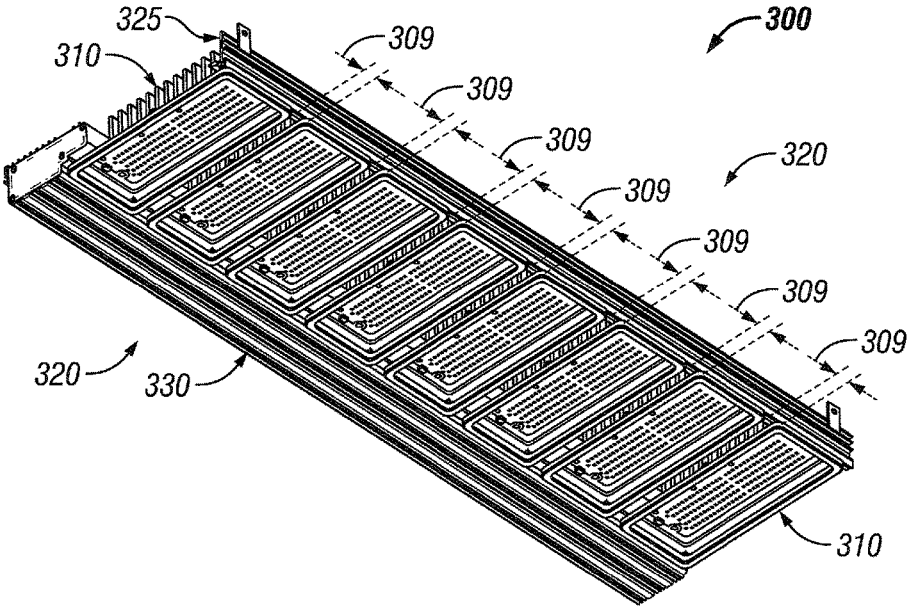

FIGS. 3A and 3B show various views of yet another modular light fixture 300 in accordance with certain example embodiments. Specifically, FIG. 3A shows a top-side perspective view of the modular light fixture 300. FIG. 3B shows a bottom-side perspective view of the modular light fixture 300. The modular light fixture 300 of FIGS. 3A and 3B is substantially the same as the modular light fixtures of FIGS. 1A-2B, except that the modular light fixture 300 has eight light modules 310. As a result, there are seven air gaps 309 between the light modules 310.

Figure 4:
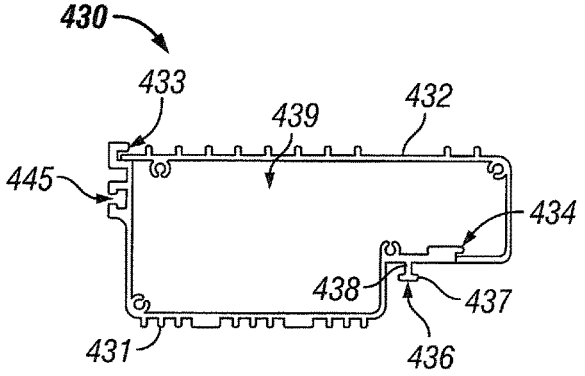
FIG. 4 shows a housing of a frame of a modular light fixture in accordance with certain example embodiments.

FIG. 4 shows a housing 430 of a frame of a modular light fixture in accordance with certain example embodiments. The housing 430 can have any of a number of characteristics (e.g., shape, size, components). For example, as shown in FIG. 4, the housing 430 can include at least one wall (in this case, a top wall 432 and a bottom wall 431) that forms a cavity 439. The top wall 432 can be movably coupled with respect to the bottom wall 431 to provide access to the cavity 439 and any components (e.g., power sources, electrical conductors, terminal blocks) disposed within the cavity 439.

For example, as shown in FIG. 4, the top wall 432 and the bottom wall 431 can have one or more coupling features 433 (e.g., tabs, latches, recesses) that complement each other and allow the top wall 432 and the bottom wall 431 to be movably (e.g., slidably, hingedly, removably) coupled to each other. As another example, also as shown in FIG. 4, the top wall 432 and the bottom wall 431 can have one or more coupling features 434 (e.g., tabs, latches, recesses) that complement each other and allow the top wall 432 and the bottom wall 431 to be movably (e.g., slidably, hingedly, removably) coupled to each other.

The wall (or portions thereof) of the housing 430 can include one or more of a number of coupling features that allow the housing 430 to couple to one or more other components of the modular light fixture. For example, as discussed above, a light module coupling device 436 can be disposed on the wall (in this case, on the outer surface of the bottom wall 431). The light module coupling device 436 can have one or more of a number of coupling features that allow the light module coupling device 436 to couple, directly or indirectly, to a complementary coupling feature (also called a frame coupling feature 611, discussed below with respect to FIGS. 6A and 6B) of a light module.

For example, in this case, the light module coupling device 436 is shaped as an inverted "T", with a stem 438 and a bottom portion 437 that is disposed at the end of, and perpendicular to, the stem 438. In this way, the stem 438 and/or the bottom portion 437 can be considered coupling features of the light module coupling device 436. The light module coupling device 436 can run along all or one or more portions of the housing 430. Further, the light module coupling device 436 can be used to expand the light modules of the light fixture in one or two dimensions.

In certain example embodiments, the housing 430 can include one or more of a number of other coupling features (e.g., an aperture) to allow the housing 430 to couple to a light module and keep the light module in a fixed position relative to the housing 430. For example, if the coupling feature is an aperture that traverses the bottom wall 431 proximate to the light module coupling device 436, the aperture can allow a fastening device (e.g., a screw, a rivet) to traverse the therethrough as well as at least a portion of a light module.

As another example of coupling features of the housing 430 that allow the housing 430 to one or more other components of the modular light fixture, coupling feature 445 (e.g., aperture, slot, recess, tab) of the bottom wall 431 can allow one or more mounting devices (e.g., mounting device 106) to couple, directly or indirectly, to the housing 430 of the frame. Further, some or all of the housing 430 can be made of one or more of a number of thermally conductive materials. As a result, the top wall 432 and/or the bottom wall 431 of the housing 430 can have one or more features (e.g., fins or protrusions, as shown in FIG. 4) to increase the surface area of the housing 430 and allow for more effective dissipation of heat absorbed by the housing 430.

Figure 5:
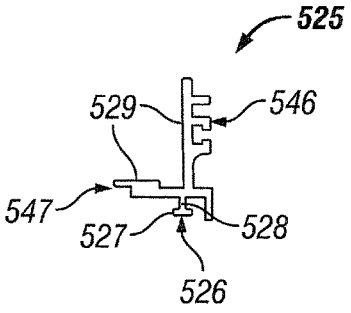
FIG. 5 shows a connecting bracket of a frame of a modular light fixture in accordance with certain example embodiments.

FIG. 5 shows a connecting bracket 525 of a frame of a modular light fixture in accordance with certain example embodiments. The connecting bracket 525 can have any of a number of characteristics (e.g., shape, size, components). For example, as shown in FIG. 4, the connecting bracket 525 can include at least one wall (in this case, wall 529). As discussed above, the connecting bracket 525 can be coupled to, or be an independent piece relative to, the housing 430.

The wall 529 (or portions thereof) of the connecting bracket 525 can include one or more of a number of coupling features that allow the connecting bracket 525 to couple to one or more other components of the modular light fixture. For example, as discussed above, a light module coupling device 526 can be disposed on the wall 529. The light module coupling device 526 can have one or more of a number of coupling features that allow the light module coupling device 526 to couple, directly or indirectly, to a complementary coupling feature (also called a frame coupling feature 611, discussed below with respect to FIGS. 6A and 6B) of a light module.

For example, in this case, the light module coupling device 526 is shaped as an inverted "T", substantially similar to the configuration of the light module coupling device 436 described above. Thus, the light module coupling device 526 can include a stem 528 and a bottom portion 527 that is disposed at the end of, and perpendicular to, the stem 528. In this way, the stem 528 and/or the bottom portion 527 can be considered coupling features of the light module coupling device 526. The light module coupling device 526 can run along all or one or more portions of the connecting bracket 525. Further, the light module coupling device 526 can be used to expand the light modules of the light fixture in one or two dimensions.

In certain example embodiments, the connecting bracket 525 can include one or more of a number of other coupling features (e.g., an aperture, a protrusion) to allow the connecting bracket 525 to couple to a light module and keep the light module in a fixed position relative to the connecting bracket 525. For example, if the coupling feature is an aperture that traverses the wall 529 proximate to the light module coupling feature 526, the aperture can allow a fastening device (e.g., a screw, a rivet) to traverse the therethrough as well as at least a portion of a light module. As another example, coupling feature 547 can be a protrusion that extends from a portion of the wall 529 so that, when the connecting bracket 525 is properly placed relative to one or more light modules, the coupling feature 547 abuts against a portion of a light module.

As another example of coupling features of the connecting bracket 525 that allow the connecting bracket 525 to one or more other components of the modular light fixture, coupling feature 546 (e.g., aperture, slot, recess, tab) of the wall 529 can allow one or more mounting devices (e.g., mounting device 106) to couple, directly or indirectly, to the connecting bracket 525 of the frame. Further, some or all of the connecting bracket 525 can be made of one or more of a number of thermally conductive materials. As a result, the wall 529 of the connecting bracket 525 can have one or more features (e.g., fins or protrusions, as shown in FIG. 5) to increase the surface area of the connecting bracket 525 and allow for more effective dissipation of heat absorbed by the connecting bracket 525.

Figure 6A:
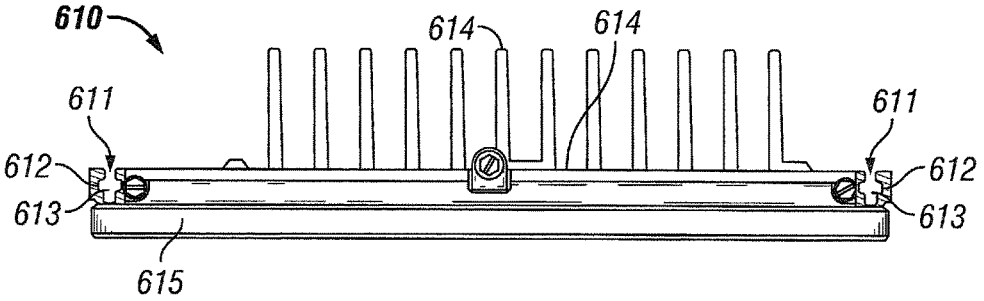
FIGS. 6A and 6B show a light module in accordance with certain example embodiments.
Figure 6B:
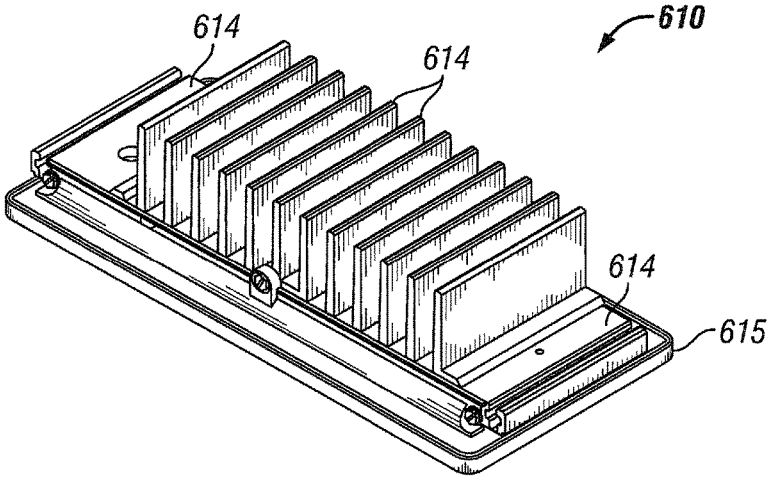

FIGS. 6A and 6B show a light module 610 in accordance with certain example embodiments. FIG. 6A shows a side view of the light module 610, and FIG. 6B shows a top-side perspective view of the light module 610. The light module 610 can include one or more of a number of features and/or components. Examples of such features can include, but are not limited to, a heat sink (e.g., heat sink 614, heat sink 615) (also called a body of the light module 610), a frame coupling feature (e.g., frame coupling feature 611), a printed circuit board (also called, among other names, a PCB, a wiring board, and a printed wiring board), a light source, a light module, a reflector, and a lens (or other form of diffuser). When a light fixture has multiple light modules 610, the characteristics (e.g., capacity, size, number of input terminals, number of light sources, type of light sources, level of voltage required) of one light module 610 can be substantially the same as, or different than, the corresponding characteristics of the remaining light modules 610 of the light fixture.

The light module 610 can have any of a number of shapes and/or sizes. In this case, the light module 610 is rectangular (when viewed from above) and has a length and a width, where the length is longer than the width. The light module 610 of FIGS. 6A and 6B includes a heat sink 614 that is in thermal communication with one or more light sources (hidden from view), a heat sink 615 that is in thermal communication with the frame (e.g., frame 120) or, alternatively, another light module 610, and a frame coupling feature 611 disposed toward each end of the light module 610 in the heat sink 614 along the width of the light module 610. Some or all of the heat sink 614 and/or the heat sink 615 can be made of one or more of a number of thermally conductive materials. The heat sink 614 can include one or more features (e.g., fins or protrusions) to increase the surface area of the heat sink 614 and allow for more effective dissipation of heat absorbed by the heat sink 614. In this case, the heat sink 614 includes a number of fins that extend from the body (e.g., the top surface, as shown in FIGS. 6A and 6B) of the heat sink 614.

Each frame coupling feature 611 has a configuration (e.g., shape, size) that complements the corresponding coupling feature of the frame to which the frame coupling feature 611 couples. In this case, since light module coupling device 436 of the housing 430 and light module coupling feature 526 of the connecting bracket 525 have substantially the same shape and size as each other, the two frame coupling features 611 that couple to the light module coupling device 436 and light module coupling feature 526 have substantially the same shape and size as each other. While a frame coupling feature 611 of a light module 610 is shown as coupling to the frame of a light fixture, a frame coupling feature 611 can, in the alternative, couple to another light module 610.

In this example, each frame coupling feature 611 is a channel disposed in the heat sink 614. As such, one frame coupling feature 611 slidably receives and couples to the light module coupling device 436 (or portion thereof) of the housing 430, and the other frame coupling feature 611 slidably receives and couples to the light module coupling feature 526 (or portion thereof) of the connecting bracket 525. The channel of each coupling feature 611 of FIGS. 6A and 6B is defined by main section 613 that has a width, as well as one or more lateral extensions 612 that has a width that is wider than the width of the main section 613. In this case, there are two lateral extensions 612 that are co-planar with each other and are disposed within the heat sink 614.

In certain example embodiments, the light module 610 can include one or more other coupling features that allow the light module 610 to couple to the frame. For example, the heat sink 614 can have one or more apertures that traverse at least partially therethrough, so that a fastening device can traverse an aperture in a portion of the frame as well as in the aperture of the heat sink 614. As another example, the heat sink 614 can have a protrusion that mates with a coupling feature (e.g., coupling feature 547) of the frame.

Figure 7A:
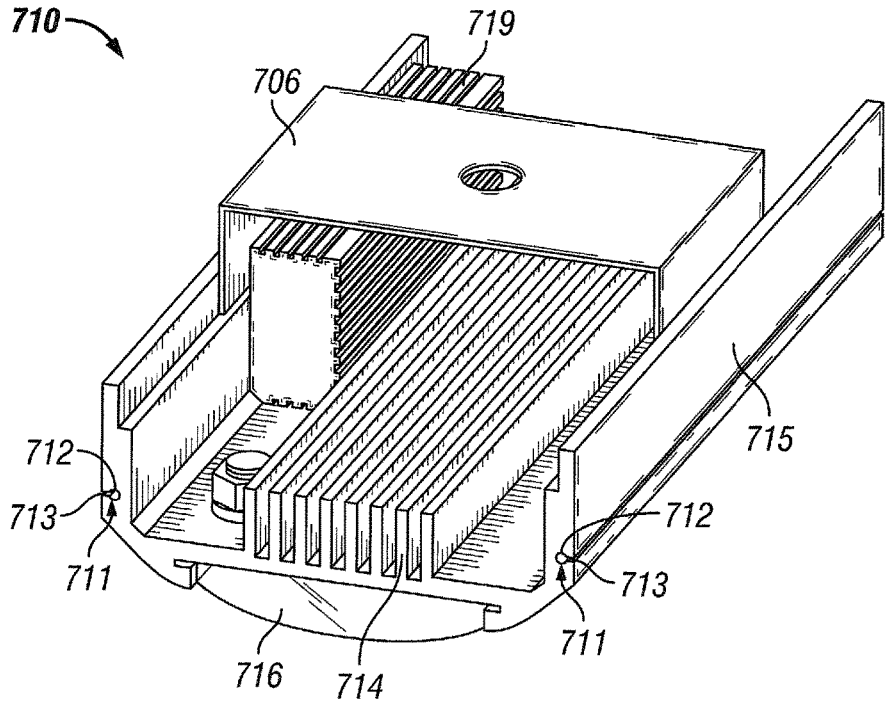
FIGS. 7A and 7B show another light module in accordance with certain example embodiments.
Figure 7B:
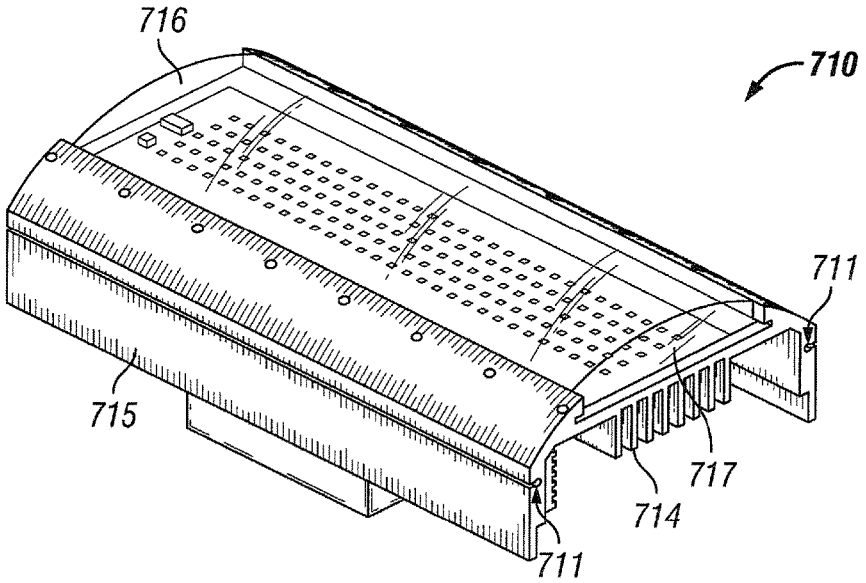

FIGS. 7A and 7B show another light module 710 in accordance with certain example embodiments. FIG. 7A shows a top-perspective view of the light module 710, and FIG. 7B shows a bottom-perspective view of the light module 710. The light module 710 of FIGS. 7A and 7B can be substantially the same as the light module 610 of FIGS. 6A and 6B, except as described below. In this case, the frame coupling features 711 are disposed along the length, as opposed to the width, of the light module 710. In addition, the frame coupling features 711 are disposed in the heat sink 715 that is in thermal communication with the frame (or another light module).

The light module 710 of FIGS. 7A and 7B show a lens 716, an array of light source assemblies 717 (which can include a number of reflectors and a number of light sources), a power source 719, and a mounting device 706. In such a case, when a light module 710 includes a power source 719, the frame may or may not include a power source that provides power and/or control signals to the light module 710.

FIG. 8 shows a light module coupling device 836 in accordance with certain example embodiments. The light module coupling device 836 of FIG. 8 is substantially similar to the light module coupling device 436 of FIG. 4 or the light module coupling device 526 of FIG. 5, except as described below. In this case, the light module coupling device 836 of FIG. 8 is a separate piece that couples to one or more light sources and/or to a frame. While the configuration of the light module coupling device 836 still includes a stem 838 and a bottom portion 837 that is disposed at the end of, and perpendicular to, the stem 838, the stem 838 can also include one or more coupling devices 808 (e.g., apertures) that help hold a light module and/or a frame in place relative to the light module coupling device 836. As with the light module coupling devices described above, the light module coupling device 836 can be of any length and can expand the light modules of the light fixture in one or two dimensions.

Figure 9A:
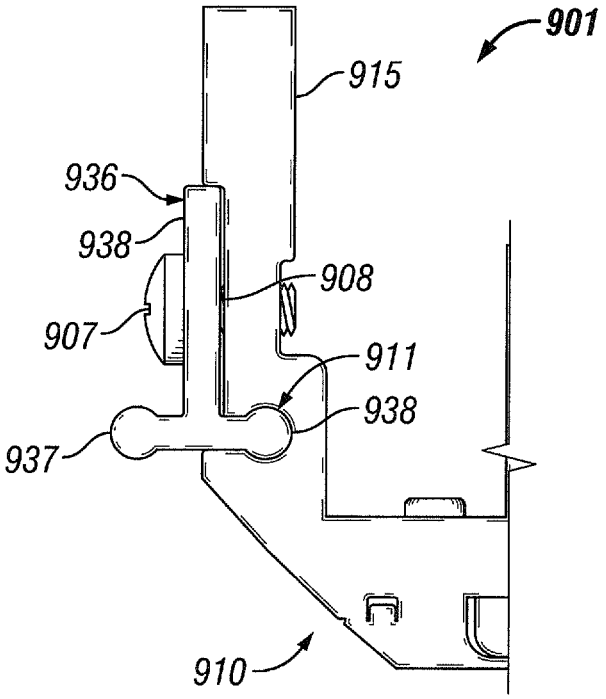
FIGS. 9A and 9B show a subassembly of a modular light fixture in accordance with certain example embodiments.
Figure 9B:
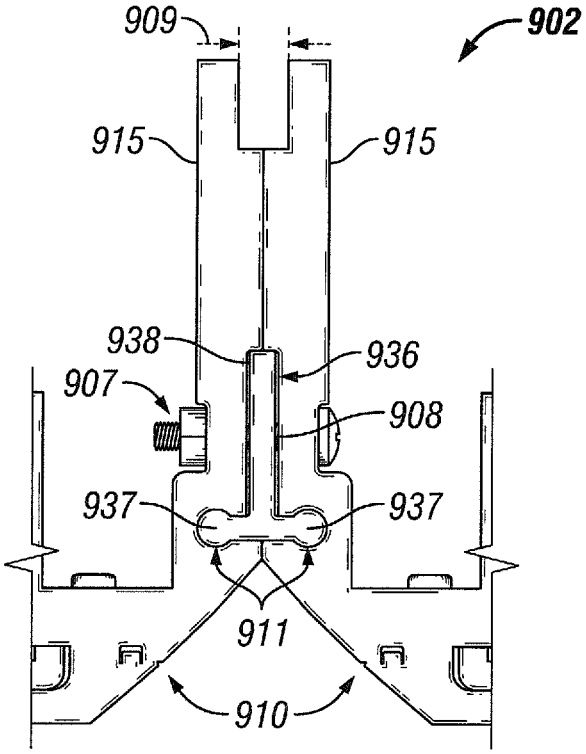

FIGS. 9A and 9B each shows a subassembly of a modular light fixture in accordance with certain example embodiments. Specifically, FIG. 9A shows a cross-sectional end view of a subassembly 901 where a light module coupling device 936 is coupled to the frame coupling device 911 of a light module 910. FIG. 9B shows a cross-sectional end view of a subassembly 902 where a light module coupling device 936 is coupled to the frame coupling device 911 of two adjacent light modules 910. The light module coupling device 936 of FIGS. 9A and 9B is substantially similar to the light module coupling device 836 of FIG. 8. Further, the light modules (including the frame coupling features 911) of FIGS. 9A and 9B are substantially similar to the light modules 710 of FIGS. 7A and 7B.

In this case, coupling feature 907 (e.g., a bolt, a nut) is used to fixedly couple the light module coupling device 936 to one or more light modules 910. Further, as shown in FIG. 9B, an air gap 909 can be disposed between adjacent light modules 910 to help improve heat dissipation for heat absorbed by the heat sinks (e.g., heat sink 915) of the light modules 910. The air gap 909 can be formed by one or more of a number of factors. Such factors can include, but are not limited to, the shape of the heat sink 915, the thickness of the stem 938 of the light module coupling device 936, and the addition of one or more spacers.

Figure 10:
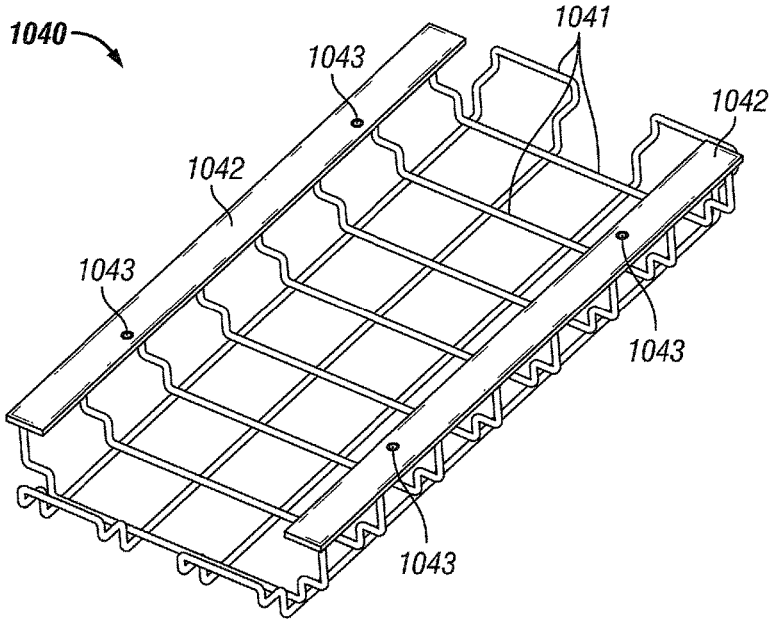
FIG. 10 shows a guard for a light module in accordance with certain example embodiments.

FIG. 10 shows a guard 1040 for a light module in accordance with certain example embodiments. The guard 1040 can be used to protect some or all of a light fixture. The example guard 1040 can be made of any suitable material (e.g., stainless steel) and have any suitable configuration to protect one or more components of the light fixture without imposing a significantly adverse effect on one or more functions (e.g., light distribution) of the light fixture. The guard 1040 can include one or more of a number of features. For example, as shown in FIG. 10, the guard 1040 can include one or more wires 1041 that form a mesh, at least one (in this case, two) mounting platforms 1042 mounted on one or more sides of the mesh formed by the wires 1041, and one or more coupling features 1043 (in this case, apertures) disposed in each mounting platform 1042. The mesh formed by the wires 1041 can have a shape (in this case, a protrusion that extends along most of the length and width of the guard 1040) and size suitable for protecting some or all of a light fixture. Each mounting platform 1042 can be configured to abut against or otherwise couple to one or more other components of a modular light fixture.

Figure 11:
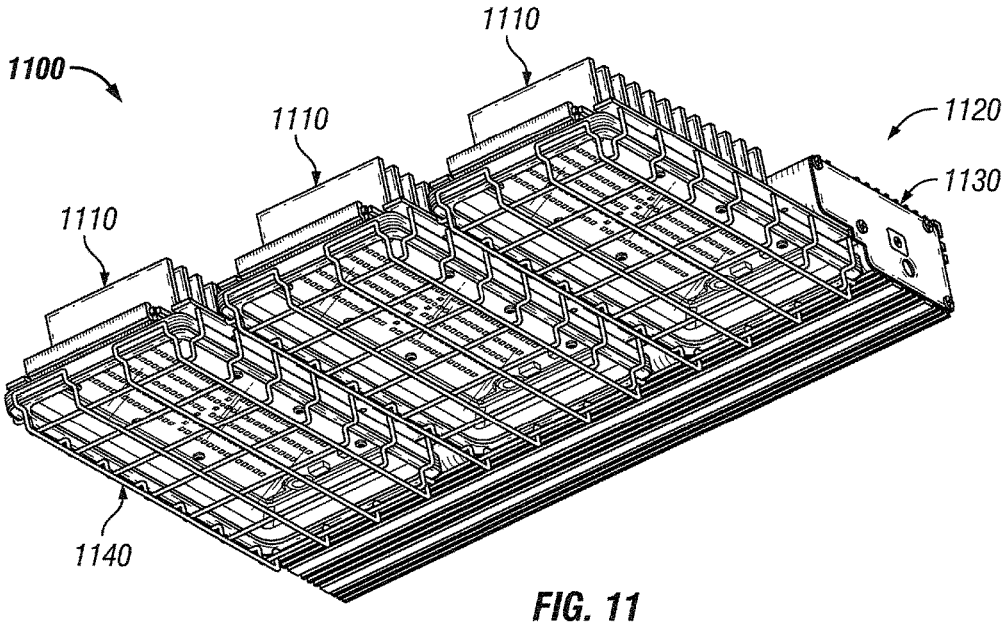
FIG. 11 shows a modular light fixture in accordance with certain example embodiments.

FIG. 11 shows a modular light fixture 1100 having a number of guards 1140 in accordance with certain example embodiments. The guards 1140 of FIG. 11 are substantially similar to the guard 1040 of FIG. 10. In this case, each guard 1140 is disposed over a bottom side of a light module 1110. In this way, the guard 1140 helps protect one or more components (e.g., the light sources, the lens, the reflectors) of the light module 1110 from large debris and certain other airborne objects. The mounting platforms 1142 of each guard 1140 can be coupled to a light module 1110, the frame 1120 (e.g., the housing 1130), and/or an adjacent guard 1140.

Figure 12B:
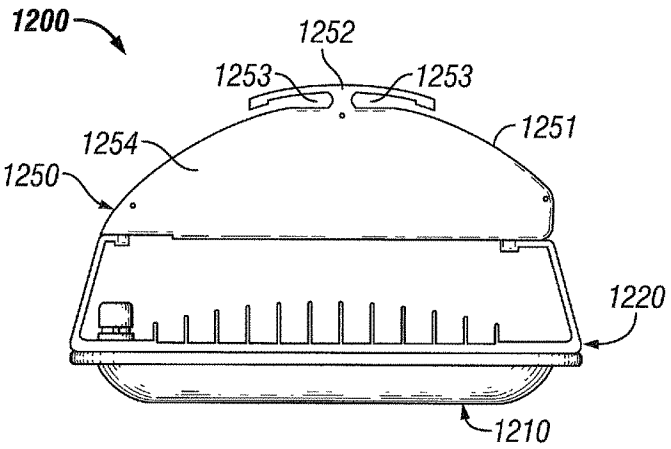
FIGS. 12A-12D shows various views of another modular light fixture with a cover in accordance with certain example embodiments.
Figure 12A:
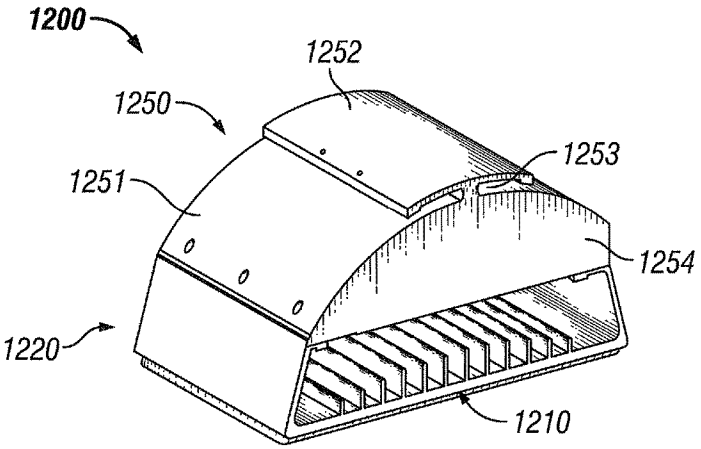
Figure 12D:
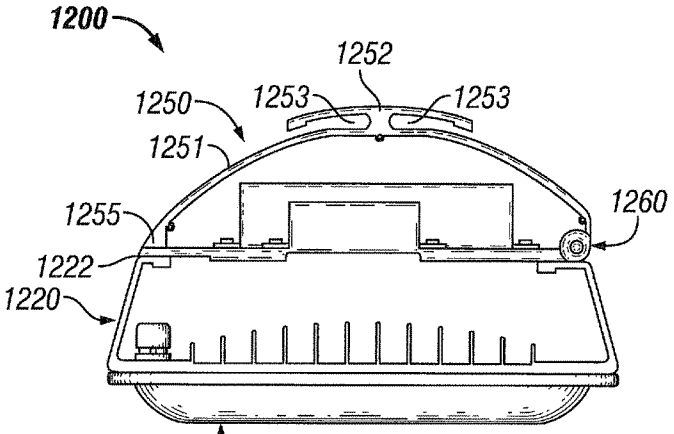
Figure 12C:
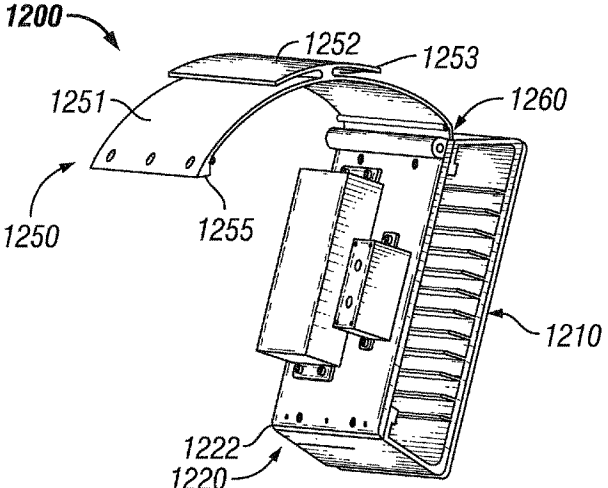

FIGS. 12A-12D shows various views of a modular light fixture 1200 that includes a cover 1250 in accordance with certain example embodiments. FIG. 12A shows an top-side perspective view of the modular light fixture 1200. FIG. 12B shows an end view of the modular light fixture 1200. FIG. 12C shows a top-side perspective view of the modular light fixture 1200 when the housing 1220 is accessible (in the open position). FIG. 12D shows a cross-sectional end view of the modular light fixture 1200. Aside from the cover 1250, the remaining components of the light fixture 1200 are substantially similar to the corresponding components of the light fixtures discussed above.

In certain example embodiments, the cover 1250 is used to provide protection to one or more components of the light fixture 1200 from elements (e.g., dust) outside the light fixture 1200. The cover 1250 can have any of a number of shapes, sizes, and other configurations. For example, as shown in FIGS. 12A-12C, the cover 1250 can include a body 1251 and an extension 1252 that is disposed above the body 1251, forming a gap 1253 between the body 1251 and the extension 1252. The extension 1252 can serve as a mounting device, such as mounting device 106 of FIGS. 1A-1D.

In some cases, the cover 1250 allow access to one of more portions of the light fixture 1250 while still remaining coupled to the rest of the light fixture 1250. For example, as shown in FIGS. 12A-12D, the cover 1250 and the frame 1220 can be hingedly coupled to each other at a hinge 1260, while also being detachably coupled to each other, in this case using a latch 1255 in the cover 1250 and a catch 1222 in the frame 1220, in another location. In such a case, when the latch 1255 and the catch 1222 are decoupled from each other (changing the light fixture 1200 from a closed position to an open position), and with the extension 1252 being fixedly coupled to some structure (e.g., ceiling, I-beam, a building wall), the tops of the frame 1220 and the light modules 1210 can be exposed to a user.

In some cases, such as when the frame 1220 includes a housing (e.g., housing 430), the housing can be opened, allowing the user to access the cavity (e.g., cavity 439) of the housing and any of a number of components (e.g., a power source) disposed therein while the light fixture 1200 remains affixed in its normal position. When any such work is completed, the user can recouple the latch 1255 and the catch 1222 to put the light fixture back into a closed position.

Figure 13A:
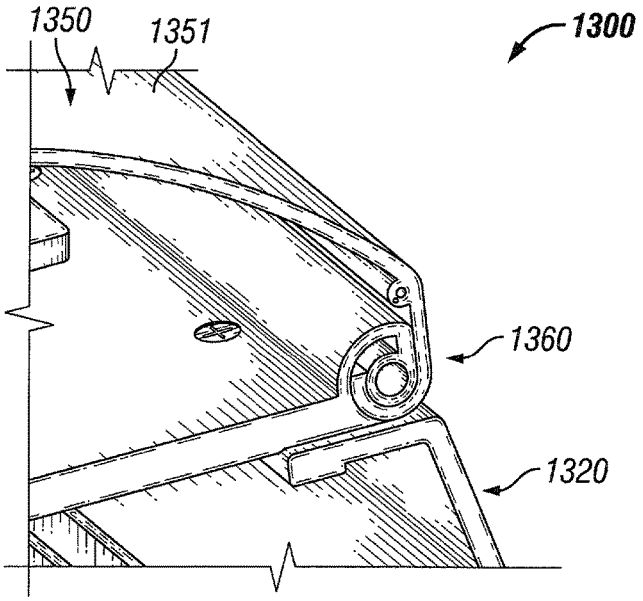
FIGS. 13A-13E show various views of a hinge assembly for a modular light fixture in accordance with certain example embodiments.
Figure 13B:
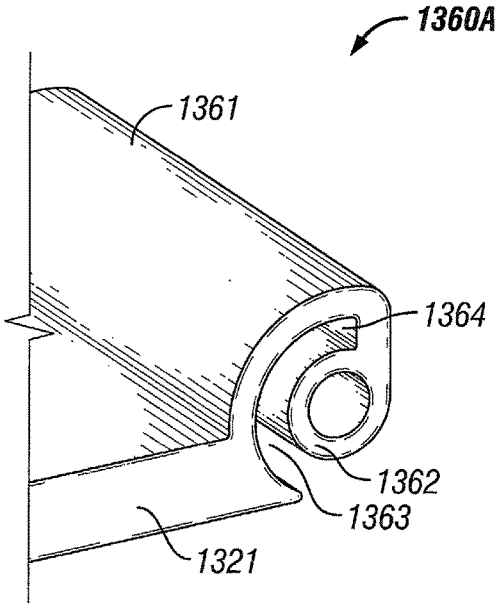
Figure 13C:
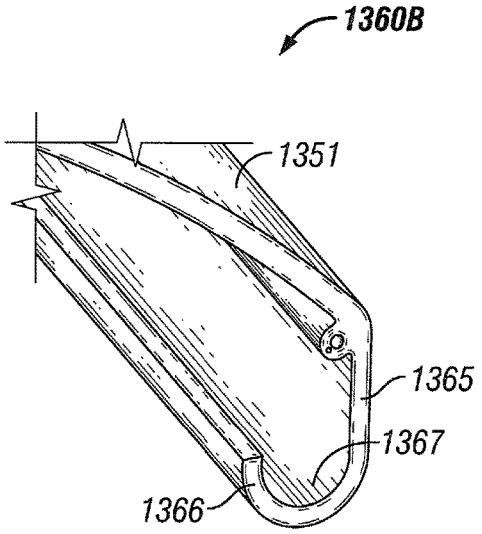
Figure 13E:
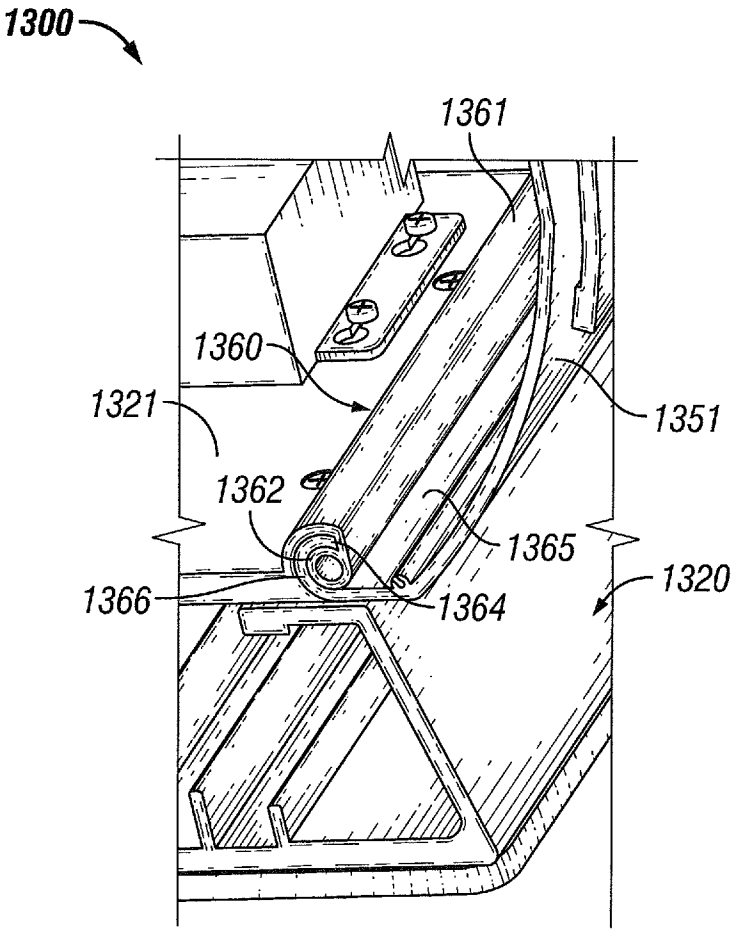
Figure 13D:
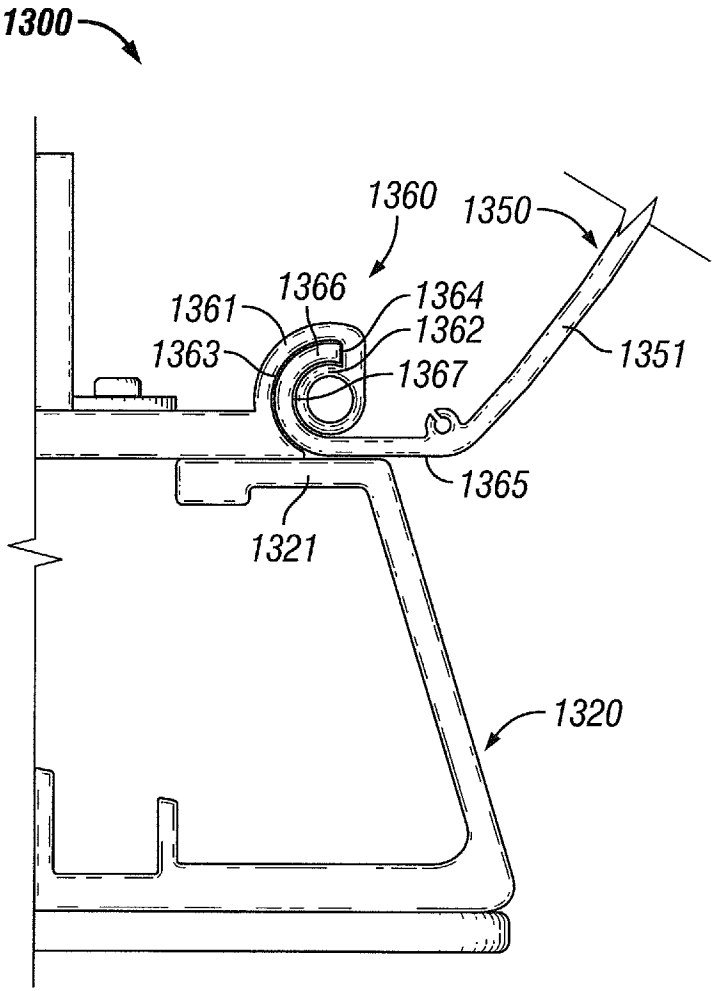

FIGS. 13A-13E show various views of a hinge assembly 1360 for a modular light fixture 1300 in accordance with certain example embodiments. FIG. 13A shows the hinge 1360 when the light fixture 1300 is in the closed position. FIG. 13B shows the frame portion 1360A of the hinge 1360. FIG. 13C shows the cover portion 1360B of the hinge 1360. FIG. 13D shows a cross-sectional side view of the hinge 1360 when the light fixture 1300 is in the open position. FIG. 13E shows a top-side perspective view of the hinge 1360 when the light fixture 1300 is in the open position. The light fixture 1300 of FIGS. 13A-13E is substantially the same as the light fixture 1200 of FIGS. 12A-12D, except as described below.

The frame portion 1360A of the hinge 1360 can have spirally-shaped components. For example, as shown in FIG. 13B, the frame portion 1360A of the hinge 1360 can include a base 1361 that extends from a top surface 1321 of the frame 1320. At the distal end of the base, an end piece 1364 extends downward at some angle (e.g., perpendicular) and wraps around itself toward its distal end into a loop 1362. A channel 1363 is formed between the loop 1362 and the base 1361, and the end piece 1364 represents the end of the channel 1363.

As another example, as shown in FIG. 13C, the cover portion 1360B of the hinge 1360 can include body 1365 that extends at some angle from the end of the body 1251 of the cover 1250. Towards the distal end of the body 1365, a curving piece 1366 is disposed, forming a cavity 1367. The curvature and height of the curving piece 1366 can be substantially the same as the curvature and height of the channel 1363. Thus, the curving piece 1366 is disposed within the channel 1363. When the light fixture is in the closed position, as in FIG. 13A, a portion of the channel 1363 is open between the distal end of the curving piece 1366 and the end piece 1364.

By contrast, when the light fixture 1300 is in the open position, the curving piece 1366 abuts against the end piece 1364. As a result, the end piece 1364 acts as a stop to prevent the cover 1350 and the frame 1320 from separating any further with respect to each other. Those of ordinary skill in the art will appreciate that the hinge configuration described herein can be used for any of a number of other applications that use hinges and hinge assemblies.

Figure 14A:
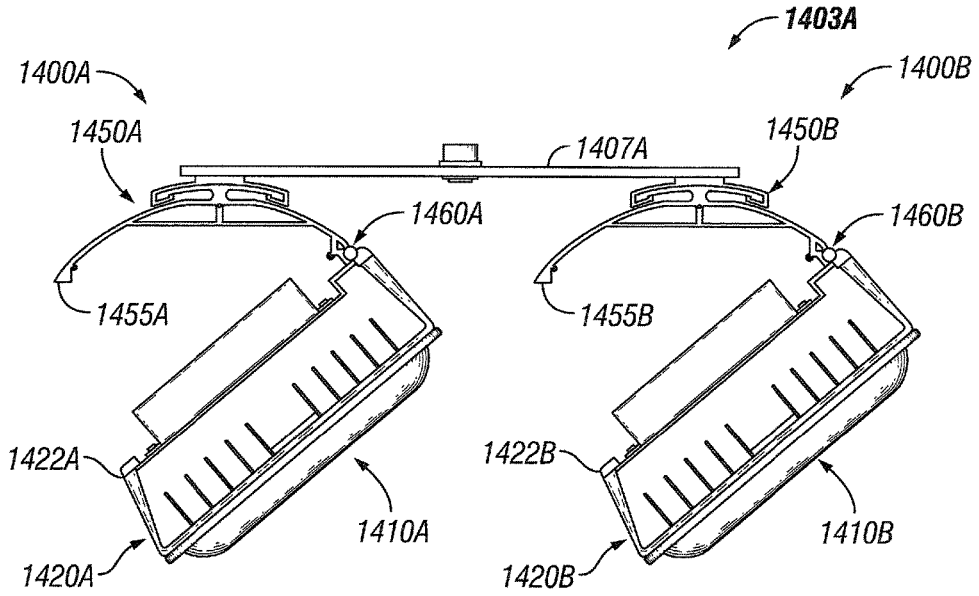
FIGS. 14A and 14B show further examples of modular light fixtures in accordance with certain example embodiments.
Figure 14B:
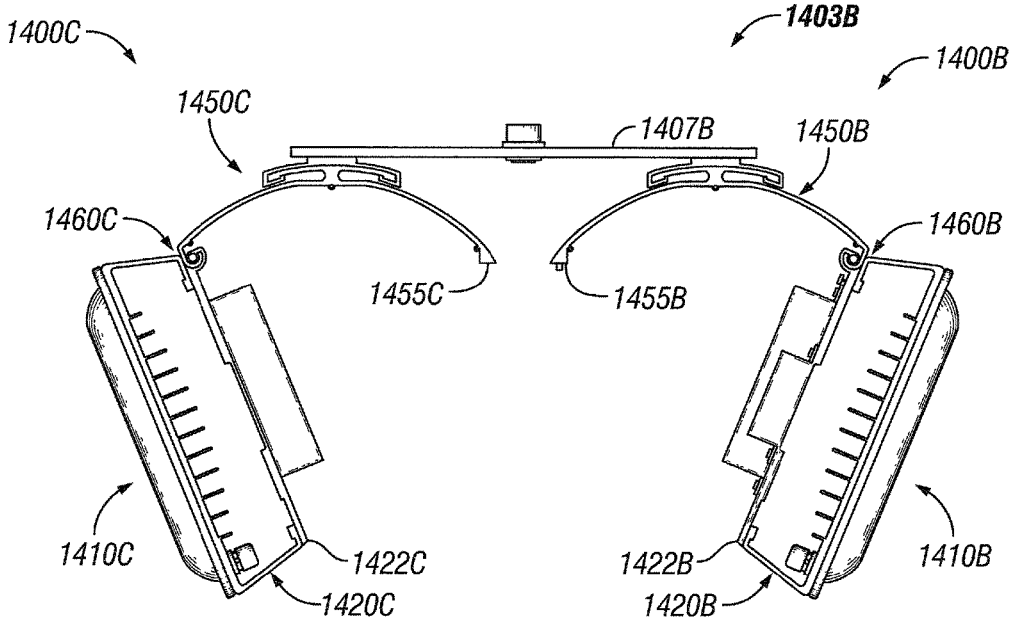

FIGS. 14A and 14B show example of light fixture assemblies in accordance with certain example embodiments. Specifically, FIG. 14A shows a light fixture assembly 1403A that includes two light fixtures (light fixture 1400A and light fixture 1400B). FIG. 14B shows another light fixture assembly 1403B that includes two light fixtures (light fixture 1400C and light fixture 1400B). The light fixtures of FIGS. 14A and 14B are substantially the same as the light fixtures of FIGS. 12A-13B, except as described below.

In the light fixture assembly 1403A of FIG. 14A, light fixture 1400A and light fixture 1400B are coupled to a mounting structure 1407A. Similarly, in the light fixture assembly 1403B of FIG. 14B, light fixture 1400C and light fixture 1400B are coupled to a mounting structure 1407B. The hinge 1460A of light fixture 1400A and the hinge 1460B of light fixture 1400B are located on the right side of each respective light fixture, and so the latch 1455 and the catch 1422 of each light fixture in FIG. 14A are located on the left side. By contrast, while the hinge 1460B of light fixture 1400B is located on the right side of light fixture 1400B, the hinge 1460C of light fixture 1400C is located on the left side of light fixture 1400C. Consequently, the latch 1455 and the catch 1422 of each light fixture in FIG. 14B are adjacent to each other.

Figure 15A:
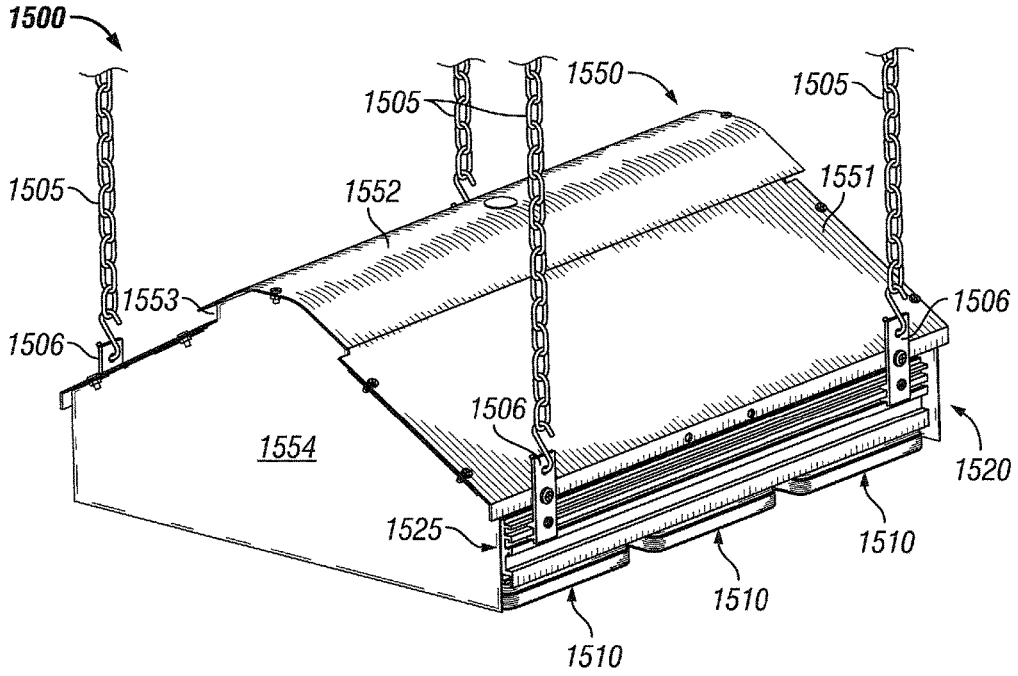
FIGS. 15A and 15B show various views of an example modular light fixture with a cover in accordance with certain example embodiments.
Figure 15B:
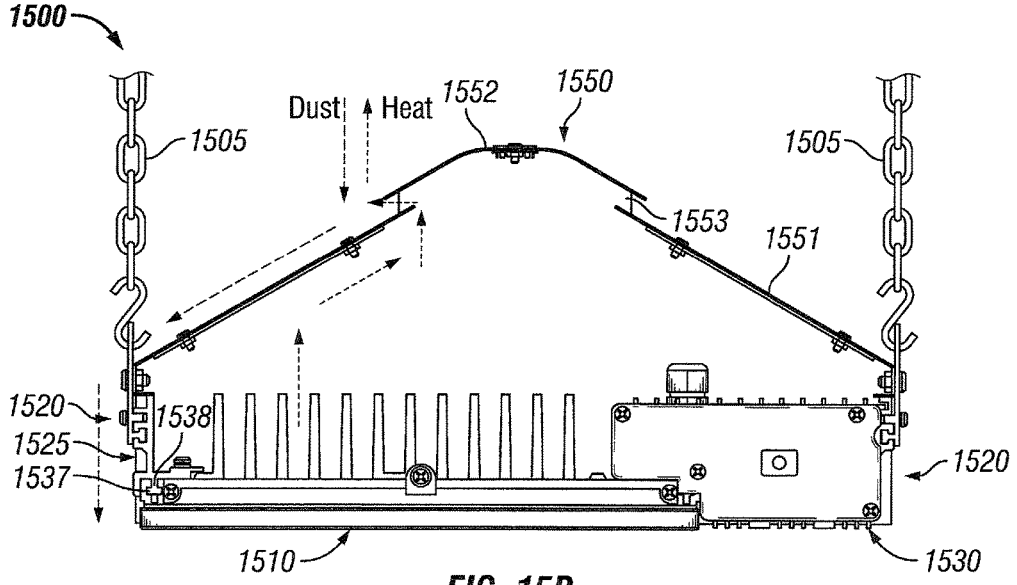

FIGS. 15A and 15B show various views of an example modular light fixture 1500 with a different cover 1550 in accordance with certain example embodiments. FIG. 15A shows an top-side perspective view of the modular light fixture 1500. FIG. 15B shows an end view of the modular light fixture 1500. The cover 1550 of FIGS. 15A and 15B is substantially the same as the cover 1250 of FIGS. 12A-12D, except as described below. In addition, the remaining components of the light fixture 1500 are substantially similar to the corresponding components of the light fixtures discussed above.

In this case, the extension 1552 of the cover 1550 is not used as an attachment means for the light fixture 1500. Instead, the gap 1553 traverses the body 1551 of the cover 1550, creating a vent. As a result, the extension 1552 serves to provide protection from dust, water, and other elements from entering the interior of the light fixture 1500 through the gap 1553. There can be any of a number of gaps 1553 that traverse the body 1551 of the cover 1550. The cover 1550 can also include a side portion 1554 on one or both ends of the light fixture 1500, enclosing the space between the cover 1550 and the tops of the frame 1520 and the light modules 1510. In certain example embodiments, the pitch of the body 1551 and/or the extension 1552 can be large enough so that most dust and dirt that settles on the cover 1550 falls off the cover 1550.

In addition, the cover 1550 can be fixedly coupled to the rest of the light fixture 1500. As a result, since the light fixture is suspended using the mounting devices 1506 disposed on the sides of the frame 1520, a user can remove the cover 1550 from the rest of the light fixture 1500 (in this case, from the frame 1520) to access one or more components disposed on the top side of the frame 1520 and/or the light modules 1510 without first removing the entire light fixture 1500 from its mounting position. In this case, the light fixture 1500 is suspended in place by a number of chains 1505 that are coupled to the mounting devices 1506.

Figure 16:
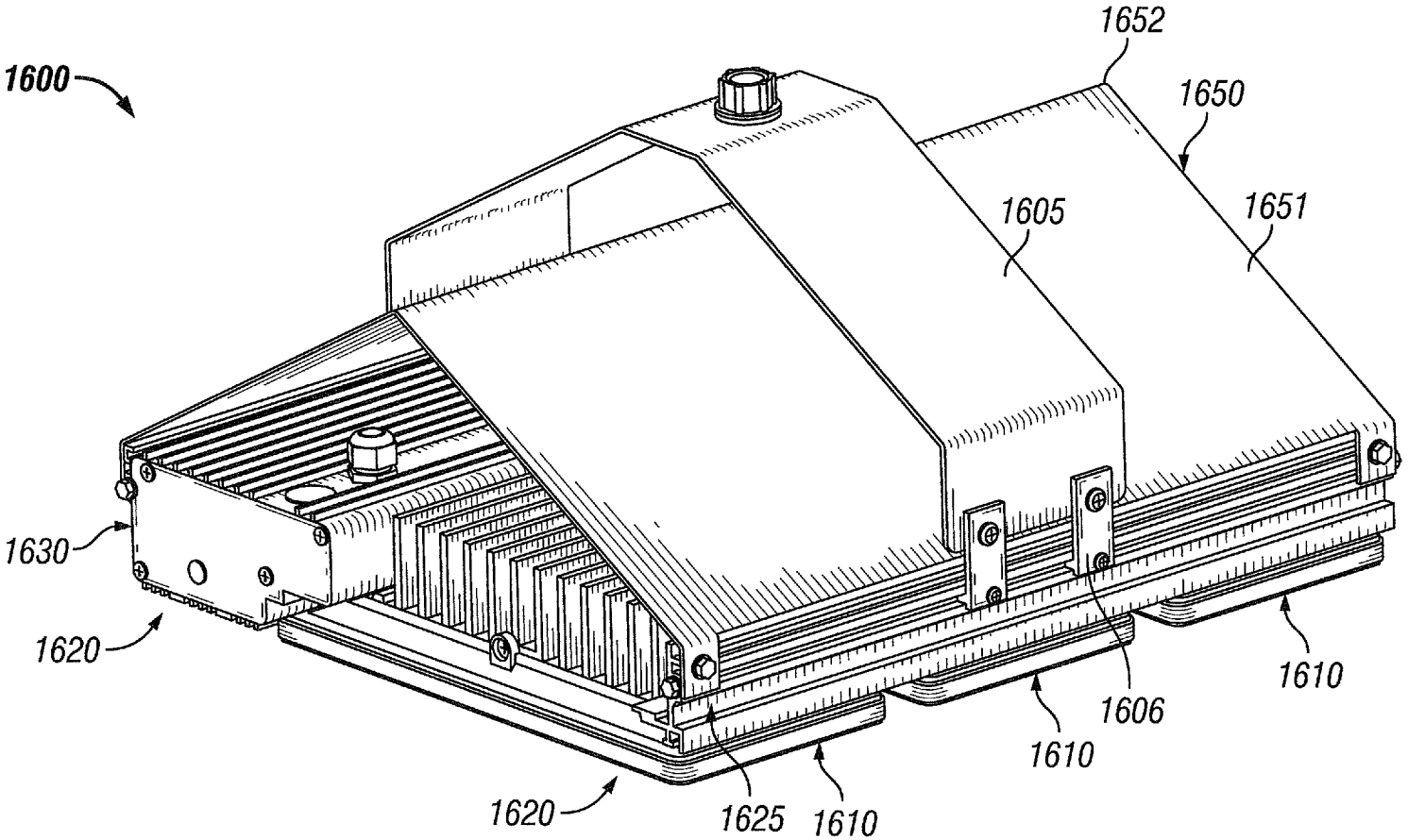
FIG. 16 shows another example modular light fixture with another cover in accordance with certain example embodiments.

FIG. 16 shows another example modular light fixture 1600 with another cover 1650 in accordance with certain example embodiments. The cover 1650 of FIG. 16 is substantially the same as the cover 1550 of FIGS. 15A and 15B, except as described below. In addition, the remaining components of the light fixture 1600 are substantially similar to the corresponding components of the light fixtures discussed above. In this case, the cover 1650 does not include any side portions, which leaves the tops of the frame 1620 and the light modules 1610 accessible by a user without removing or otherwise manipulating the cover 1650.

In addition, a bracket 1605 is attached to the mounting devices 1606 disposed on the sides of the frame 1620. The bracket 1605 is bridged over the housing 1650 and has a coupling feature disposed in its center, allowing for the bracket 1605 to couple to a pendant or some similar mounting feature. The location of the mounting devices 1606 along the sides of the frame 1620 is adjustable, as can be seen in FIG. 16 relative to the position of the mounting devices 1506 shown in FIGS. 15A and 15B. As a result of the adjustability of the mounting devices (e.g., mounting devices 1506), an example light fixture can mount to any of a number of devices (e.g., a pendant, a hook, an I-beam, a bracket, a jack chain, an aircraft cable) that are attached to any of a number of mounting surfaces (e.g., a building wall, a ceiling).

Figure 17A:
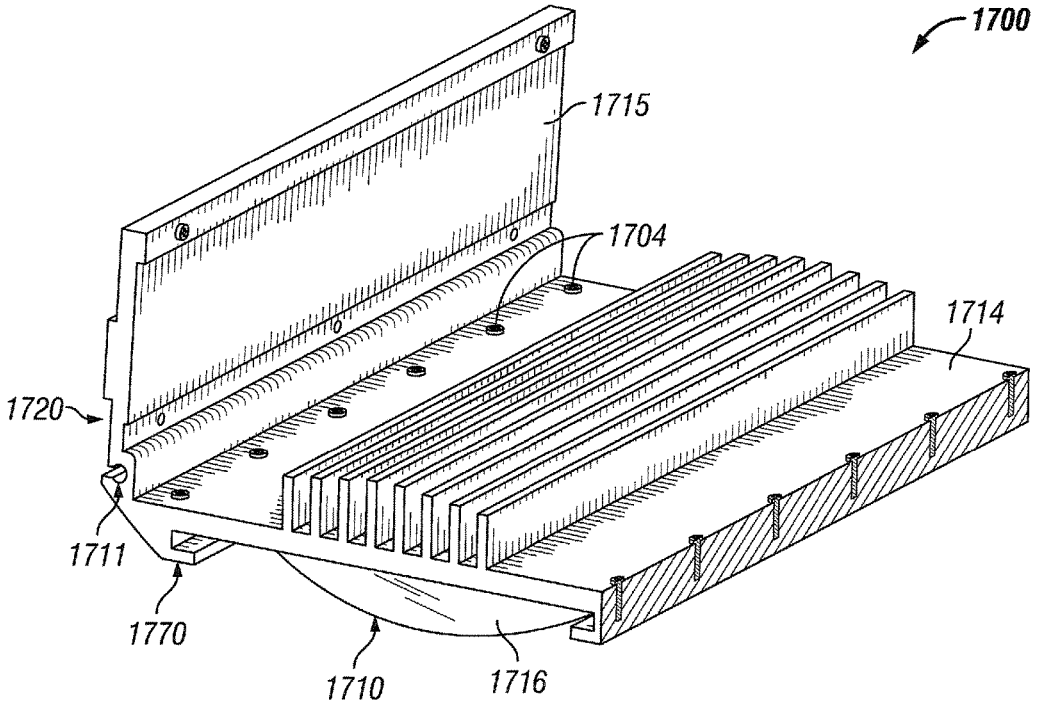
FIGS. 17A and 17B show various views of a modular light fixture that includes a clamp in accordance with certain example embodiments.
Figure 17B:
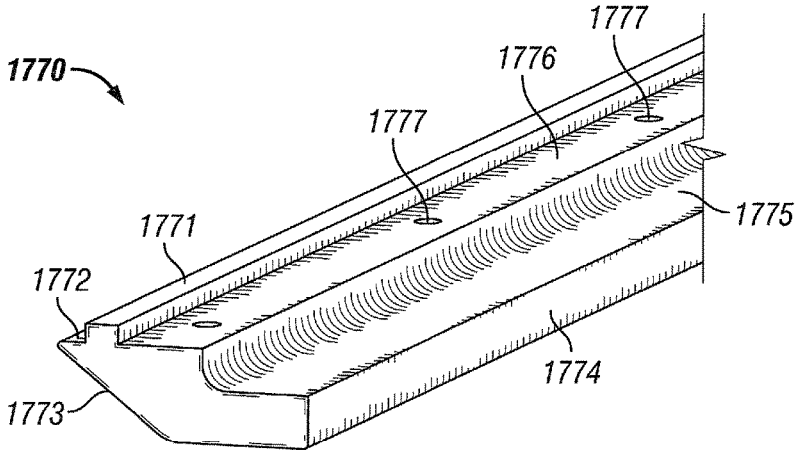

FIGS. 17A and 17B show various views of a portion of a modular light fixture 1700 includes a clamp 1770 accordance with certain example embodiments. FIG. 17A shows a top-perspective view of the light fixture 1700, and FIG. 17B shows a top-perspective view of the clamp 1770. The light fixture 1700 of FIGS. 17A and 17B are substantially similar to the light fixtures discussed herein, except as described below. Specifically, one or more example clamps 1770 can be used to secure (couple to) one or more components of the light fixture 1700. For example, in this case, the clamp 1770 is used to secure the lens 1716 to the heat sink 1714 of the light module 1710.

The clamp 1770 can include one or more coupling features. For example, as shown in FIG. 17B, the clamp 1770 can have one or more coupling features (e.g., a protrusion 1771) that extends upward from the body 1773 of the clamp 1770 to couple to a complementary coupling feature (e.g., a channel) in another component (e.g., the heat sink 1714) of the light fixture 1700. As another example, a top portion 1776 of the clamp 1770 can have another one or more coupling features (e.g., apertures 1777) that traverse the body 1773 of the clamp 1770 to indirectly couple to a complementary coupling feature (e.g., another aperture) in another component (e.g., the heat sink 1714) of the light fixture 1700. In such a case, a coupling device 1704 (e.g., screw, bolt, rivet) can be disposed in these apertures to couple the clamp 1770 and the heat sink 1714.

The shape, size, and contours of the clamp 1770 (e.g., top surface 1775, side surface 1774, top surface 1772) can be designed to complement features of one or more components (e.g., heat sink 1714, lens 1716) of the light fixture 1700 so that all components abut against the clamp 1770 when the clamp 1770 is coupled to the light fixture 1700. In this way, the clamp 1770 can provide a substantially tight seal, protecting one or more components (e.g., light sources, reflectors) of the light fixture 1700.

Figure 18A:
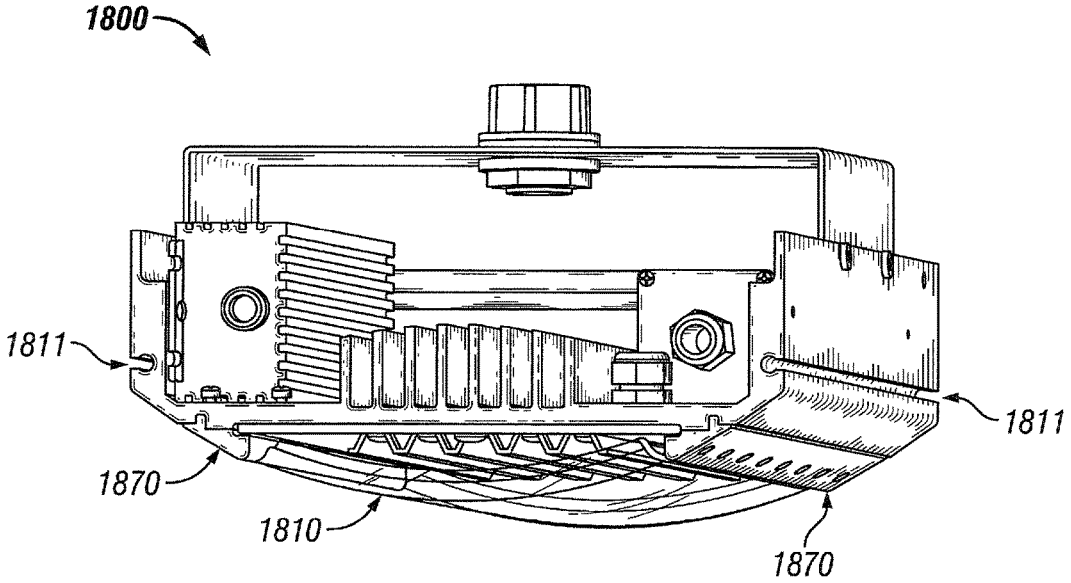
FIGS. 18A and 18B show various views of another modular light fixture that includes a clamp in accordance with certain example embodiments.
Figure 18B:
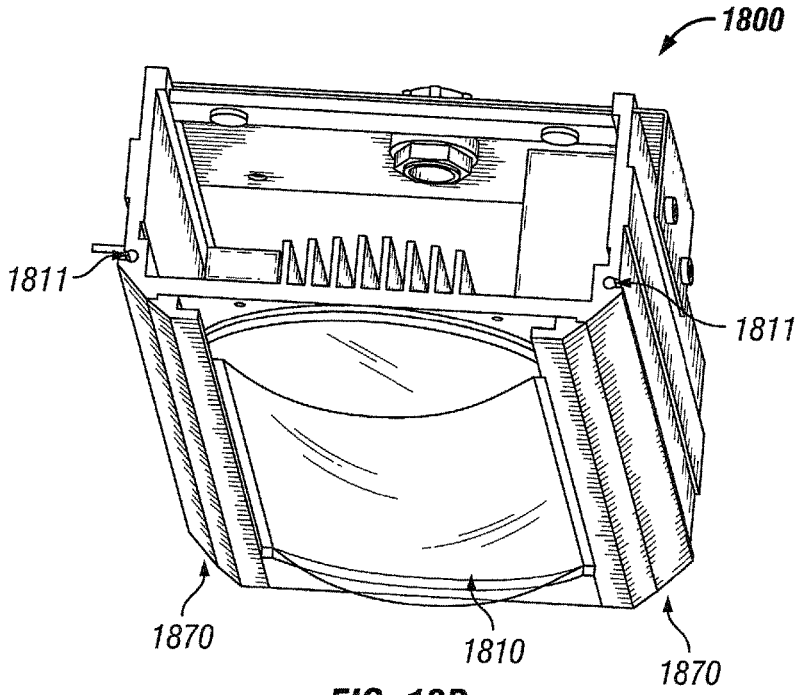

FIGS. 18A and 18B show various views of another modular light fixture 1800 that includes a clamp 1870 in accordance with certain example embodiments. The clamp 1870 of FIGS. 18A and 18B is substantially the same as the clamp 1770 of FIGS. 17A and 17B. Further, the remaining components of the light fixture 1800 of FIGS. 18A and 18B are substantially the same as the corresponding components of the light fixtures described herein. In this case, the light fixture 1800 of FIGS. 18A and 18B provide views of an entire light module 1810 of the light fixture 1800.

Figure 19:
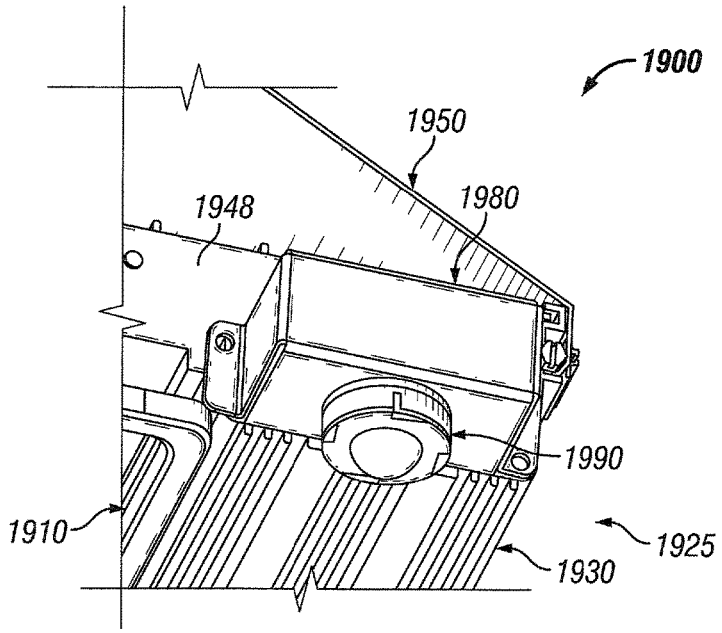
FIGS. 19-22 show various modular light fixtures with sensor mounting arrangements in accordance with certain example embodiments.
Figure 20:
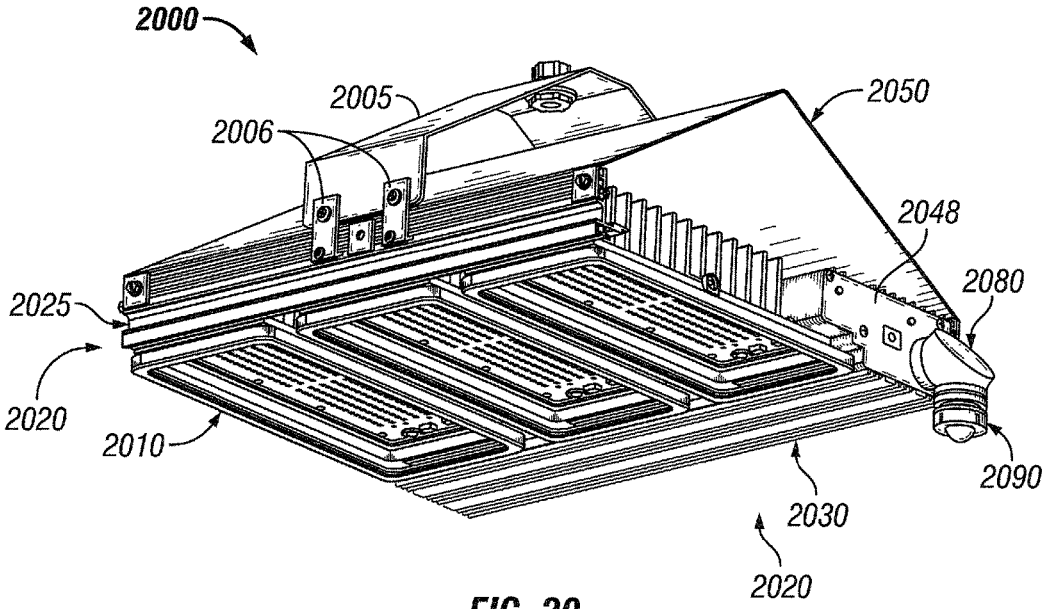
Figure 21:
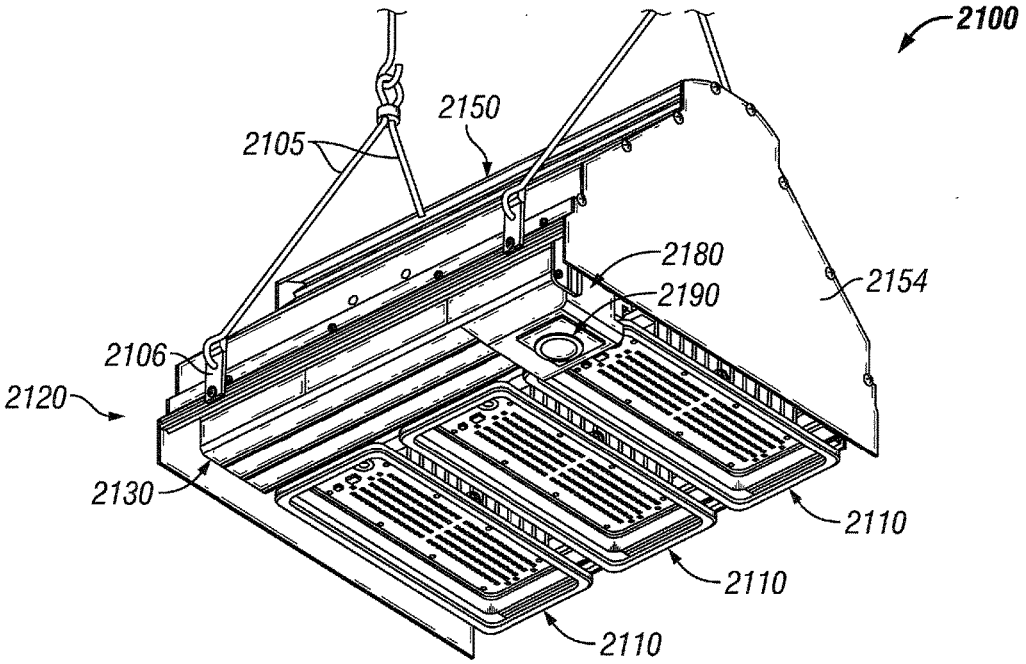
Figure 22:
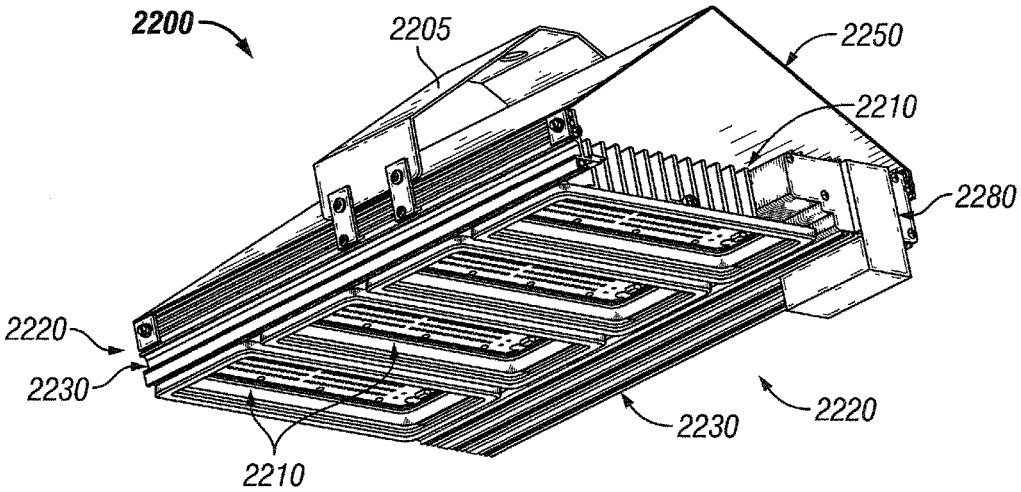

FIGS. 19-22 show various modular light fixtures with sensor mounting arrangements in accordance with certain example embodiments. FIG. 19 shows a light fixture 1900 that includes a sensor mounting arrangement 1980. FIG. 20 shows a light fixture 2000 that includes another sensor mounting arrangement 2080. FIG. 21 shows a light fixture 2100 that includes yet another sensor mounting arrangement 2180. FIG. 22 shows a light fixture 2200 that includes still another sensor mounting arrangement 2280. Aside from the various sensor mounting arrangements, which are discussed below, the various components of the light fixtures of FIGS. 19-22 are substantially the same as the corresponding components of the light fixtures described herein.

In certain example embodiments, the various sensor mounting arrangements of FIGS. 19-22 allow a sensor (e.g., a motion sensor, a photocell, an infrared sensor) that is used in the operation of the light fixture to be mounted to the example light fixtures described herein, while also protecting the sensors and associated components (e.g., wiring) of the sensors. For the light fixture 1900 of FIG. 19, the sensor 1990 is attached to a bottom surface of the sensor mounting arrangement 1980, which in this case is an enclosed housing that is attached to an end 1948 of the housing 1930 of the frame 1920.

For the light fixture 2000 of FIG. 20, the sensor 2090 is attached to a bottom surface of the sensor mounting arrangement 2080, which in this case is an elbow mount that extends away and downward from the end 2048 of the housing 2030 of the frame 2020. For the light fixture 2100 of FIG. 21, the sensor 2190 is attached to a bottom surface of the sensor mounting arrangement 2180, which in this case is an enclosed housing is mounted to the outer surface of the bottom wall 2131 of the housing 2030 of the frame 2020. For the light fixture 2200 of FIG. 22, the sensor (hidden from view) is enclosed within the sensor mounting arrangement 2280, which in this case is an enclosed housing is mounted to the outer surface of the bottom wall 2231 of the housing 2230 of the frame 2220.

Figure 23:
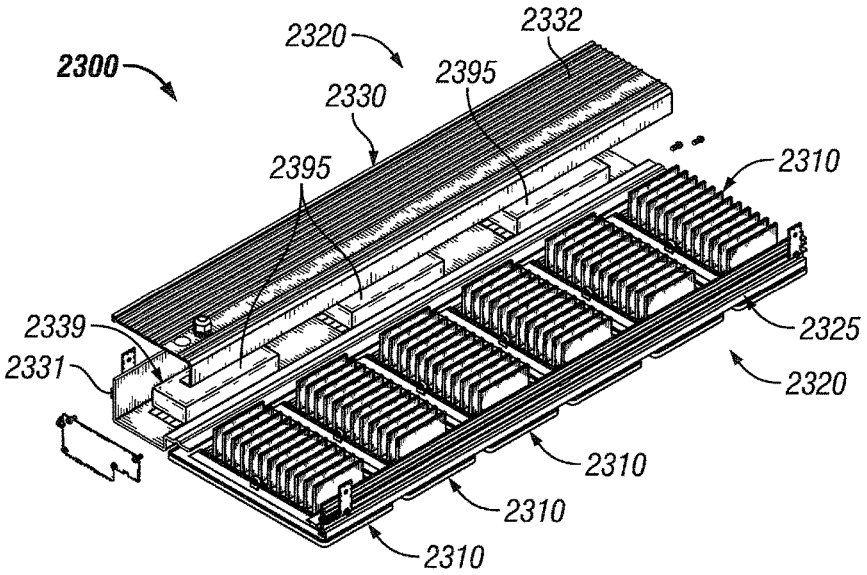
FIGS. 23 and 24 show partially exploded views of modular light fixtures in accordance with certain example embodiments.
Figure 24:
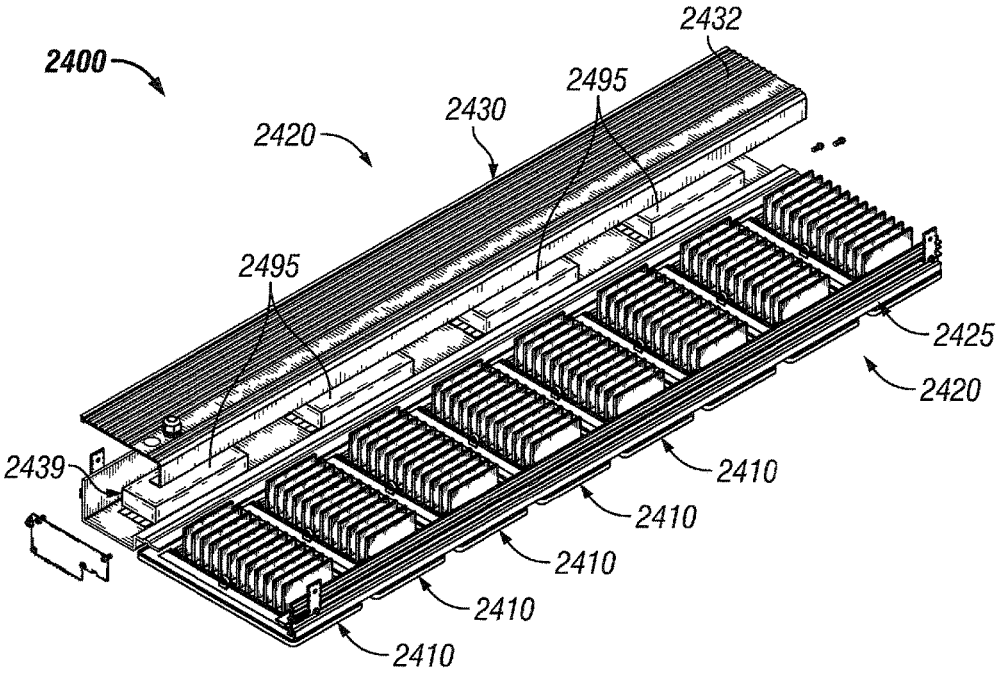

FIGS. 23 and 24 show partially exploded views of modular light fixtures in accordance with certain example embodiments. Specifically, FIG. 23 shows a partially exploded view of modular light fixture 2300, and FIG. 24 shows a partially exploded view of modular light fixture 2400. The modular light fixture 2300 of FIG. 23 and the modular light fixture 2400 of FIG. 24 are substantially the same as the modular light fixtures of FIGS. 1A-6B. In this case, the housing 2330 of the frame 2320 of the light fixture 2300 in FIG. 23 is exploded, showing the components of the frame 2320 disposed within the cavity 2339 formed by the top wall 2331 and the bottom wall 2332.

In this case, there are three power sources 2395 disposed within the cavity 2339. Each power source 2395 can supply power and/or control signals to one or more of the light modules 2310. Alternatively, a power source 2395 can be idle, not providing power or control signals to any of the light modules 2310. In certain example embodiments, a power source 2395 can change the one or more light modules 2310 that it provides power and/or control signals based on one or more of a number of conditions, including but not limited to a passage of time, a change in power received by the power source 2395, the number of light modules 2310, and a user selection.

The power sources 2395 can be wired in series and/or in parallel. The characteristics (e.g., capacity, size, number of input terminals, number of output terminals, type of voltage output, level of voltage output) of each power source 2395 can be substantially the same as, or different than, the corresponding characteristics of the remaining power sources 2395 of the light fixture 2300. The light fixture 2400 of FIG. 24 is substantially the same as the light fixture 2300 of FIG. 23, except that there are four power sources 2495 disposed within the cavity 2439 of the housing 2430 formed by the top wall 2431 and the bottom wall 2432. In addition, the light fixture 2400 of FIG. 24 has eight light modules 2410 as opposed to the six light modules 2310 of the light fixture 2300 of FIG. 23.

Figure 25:
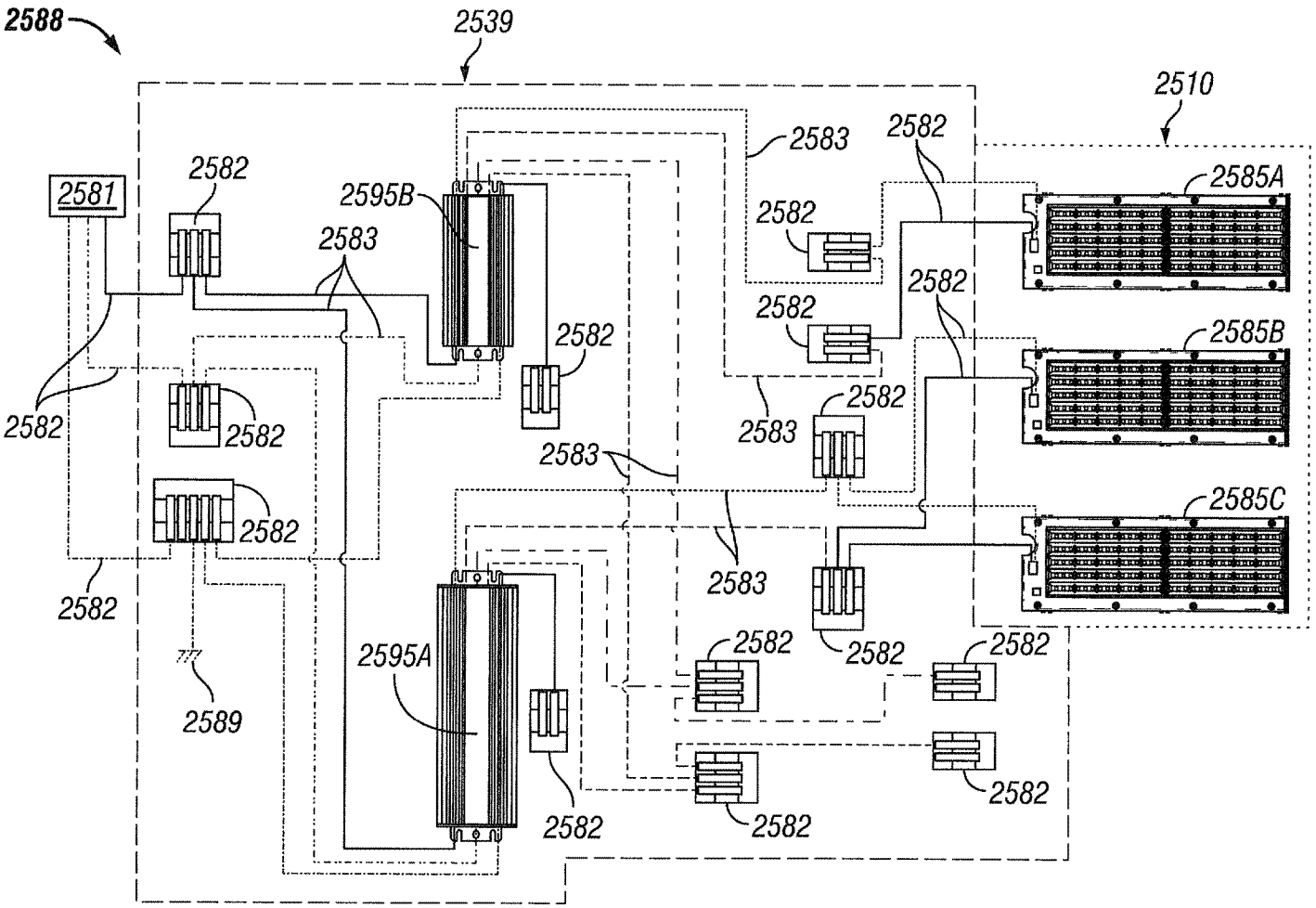
FIGS. 25 and 26 show wiring diagrams of modular light fixtures in accordance with certain example embodiments.
Figure 26:
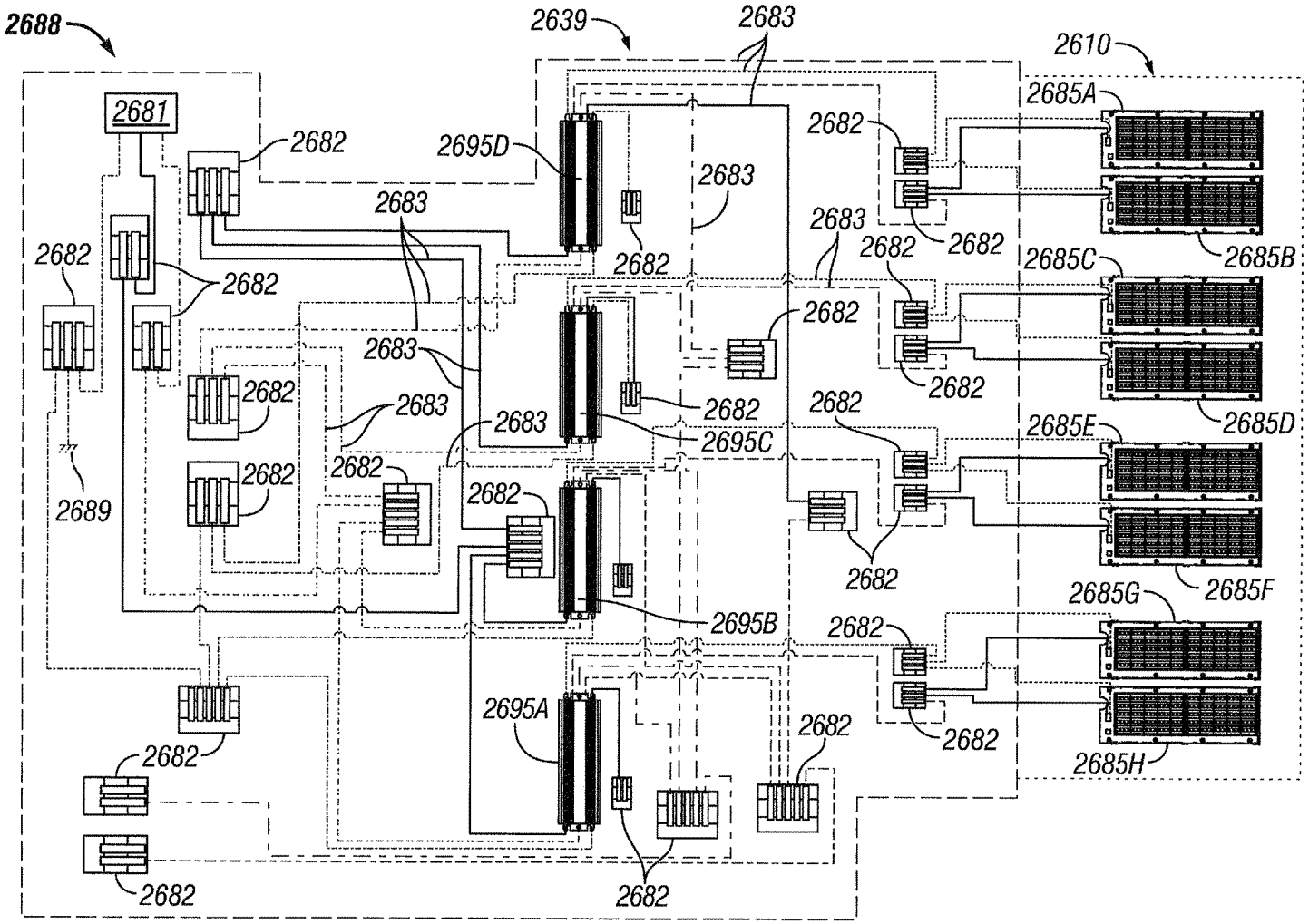

FIGS. 25 and 26 show wiring diagrams of modular light fixtures in accordance with certain example embodiments. Specifically, FIG. 25 shows a wiring diagram 2588 of a light fixture, and FIG. 26 shows a wiring diagram 2688 of another light fixture. As discussed above, there can be one or more of a number of components disposed within the housing of a frame and/or in a light module of a light fixture. The examples shown in FIGS. 25 and 26 show components disposed in the housing of a frame of a light fixture. For example, in the wiring diagram 2588 of FIG. 25, there are a number (in this case, 13) of terminal blocks 2582, a number (in this case, two) of power sources 2395, and a number of electrical conductors 2583 disposed within the cavity 2539 of the housing 2530 of the frame 2520 of the light fixture 2500. Similarly, there are a number (in this case, three) of circuit boards 2585 that are part of one or more light modules 2510.

The power sources 2595 are supplied with power from an external power source 2581. In some cases, the power supplied by the external power source 2581 to the power sources 2595 is alternating current (AC) power. There can be multiple external power sources 2581, where each external power source 2581 supplies power to one or more power sources 2595. Each power source 2595 can receive the power from the external power source 2581 and generate output power and/or control signals that are sent to one or more circuit boards 2585. In this case, power source 2595A has at least one characteristic (e.g., size, capacity) that is different than a corresponding characteristic of power source 2595B.

The terminal blocks 2582 can have varying characteristics, including but not limited to number of terminals, shape of terminals, rating of terminals, and location of terminals. Similarly, the size and other characteristics of an electrical conductor 2583 can be based on one or more of a number of factors, including but not limited to level of voltage/current flowing through the electrical conductor 2582 and the temperature that the electrical conductor 2582 is exposed to. A circuit for a light fixture can also have an earth ground 2589.

The wiring shown in the wiring diagram 2588 of FIG. 25 can be set during manufacturing and not subject to alteration by a user after the manufacturing process. Alternatively, one or more aspects of the wiring diagram 2588 can be altered by a user in the field, after manufacturing. For example, if an additional light module 2510 is added to the light fixture, a user can make adjustments (e.g., rewire, add a power source 2595) in the field to accommodate the additional light module 2510. As another example, if a light module 2510 is replaced with a light module that has one or more different characteristics (e.g., higher current requirement), a user can make adjustments in the field to accommodate the replacement light module 2510.

Other components can be included in the wiring diagram 2588 of FIG. 25. For example, the wiring diagram 2588 can include one or more switches and/or one or more timers. This can allow a power source (e.g., power source 2595A) to supply power and control signals to one light module (e.g., corresponding to circuit board 2585A) for one period of time (e.g., working hours), and then allow another power source (e.g., power source 2595B) to supply power and control signals to the same light module (e.g., corresponding to circuit board 2585A) for another period of time (e.g., non-working hours).

The wiring diagram 2688 of FIG. 26 is substantially similar to the wiring diagram 2588 of FIG. 25, except that there are more power sources 2695 (four instead of two), more terminal blocks 2682 (27 instead of 13), more electrical conductors 2683, and more circuit boards 2685 (eight instead of three), which may or may not translate to more light modules 2610 compared to the number of light modules 2510 for the light fixture of FIG. 25. In this case, the four power sources 2695 (power source 2695A, power source 2695B, power source 2695C, and power source 2695D) have substantially the same characteristics as each other.

Example embodiments can be installed without complicated electrical and/or mechanical manipulation or expertise. In other words, many issues common to installing a lighting fixture (e.g., having sufficient light coverage, having the desired number of light modules) can be avoided or minimized using example modular light fixtures. Using example embodiments described herein, the light fixture can be more energy efficient, provide more effective lighting for a particular application, provide particular types of lighting, have optical features that can be easily changed at some point in the future by a user, and provide a number of other benefits expressed or implied herein.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A modular light fixture, comprising:

a frame comprising:

a housing comprising at least one housing wall that forms a cavity;

at least one first light module coupling device disposed on the at least one housing wall, wherein the at least one first light module coupling device comprises at least one first light module coupling feature;

a first mounting device coupled to the at least one housing wall of the housing; and a connecting bracket comprising at least one second light module coupling device and a second mounting device disposed thereon, wherein the at least one second light module coupling device comprises at least one second light module coupling feature;

a first power source disposed within the cavity of the housing; and a first light module mechanically coupled to the frame and electrically coupled to the first power source, wherein the first light module comprises at least one first frame coupling feature that couples to the at least one first light module coupling feature of the at least one first light module coupling device disposed on the at least one housing wall of the housing, and wherein the first light module further comprises at least one second frame coupling feature that couples to the at least one second light module coupling feature of the at least one light module coupling device disposed on the connecting bracket, wherein the housing is coupled to a first end of the first light module, wherein the connecting bracket is coupled to a second end of the first light module that opposes the first end, wherein the first mounting device and the second mounting device are used to suspend the frame, wherein the housing and the connecting bracket, without the first light module, are uncoupled from each other, and wherein the first power source provides a first power to the first light module.

2. The modular light fixture of claim 1, further comprising:

a second light module mechanically coupled to the frame, wherein the second light module comprises at least one third frame coupling feature that couples to the at least one first light module coupling feature of the at least one light module coupling device disposed on the at least one housing wall of the housing, and wherein the second light module further comprises at least one fourth frame coupling feature that couples to the at least one second light module coupling feature of the at least one light module coupling device disposed on the connecting bracket, wherein the housing is disposed at a third end of the second light module, wherein the connecting bracket is disposed at a fourth end of the second light module that opposes the third end.

3. The modular light fixture of claim 2, further comprising:

a second power source disposed within the cavity of the housing, wherein the second power source provides a second power to the second light module.

4. The modular light fixture of claim 3, wherein the first power source provides the first power to the first light module during a first time period, and wherein the second power source provides the second power to the second light module during the first time period.

5. The modular light fixture of claim 4, wherein the first power source provides the first power to the first light module and the second light module during a second time period.

6. The modular light fixture of claim 1, wherein the at least one frame coupling feature comprises at least one first channel disposed in a light module wall of the first light module, wherein the at least one channel slidably receives the at least one light module coupling feature.

7. The modular light fixture of claim 6, wherein the at least one first channel has a first width at the light module wall of the first light module and a second width within the light module wall of the first light module, wherein the second width is greater than the first width.

8. The modular light fixture of claim 1, further comprising:

at least one securing member that holds the first module in a fixed position relative to the housing and the connecting bracket of the frame.

9. The modular light fixture of claim 8, wherein the at least one securing member comprises a first fastening device that traverses the at least one wall of the housing and at least a first portion of the first light module and a second fastening device that traverses the connecting bracket and at least a second portion of the first light module.

10. The modular light fixture of claim 1, wherein the at least one housing wall of the housing is movable relative to the housing to allow access to the cavity when the first light module is coupled to the frame.

11. The modular light fixture of claim 2, wherein the first light module and the second light module are separated by an air gap, wherein the air gap is adjustable.

12. The modular light fixture of claim 11, wherein the first light module comprises a length and a width, wherein the length is longer than the width, wherein the length defines the first end and the second end.

13. The modular light fixture of claim 11, wherein the air gap is adjustable and allows ambient air to flow between the first light module and the second light module, and wherein the ambient air removes heat absorbed by the first light module and the second light module.

14. A light module for a modular light fixture, the light module comprising:

a body comprising a length and a width, wherein the width defines a first end and a second end of the body, and wherein the length defines a first side and a second side of the body;

a first frame coupling feature disposed at the first end of the body, wherein the first frame coupling feature is configured to couple to a first light module coupling feature of a housing of a frame of the modular light fixture; and a second frame coupling feature disposed at a second end of the body, wherein the second frame coupling feature is configured to couple to a second light module coupling feature of a connecting bracket of the frame of the module light fixture, wherein the first frame coupling feature is configured to be adjustable along the first light module coupling feature of the housing of the frame, and wherein the housing and the connecting bracket are uncoupled to each other without the body.

15. The light module of claim 14, wherein the second frame coupling feature is configured to be adjustable along the second light module coupling feature of the frame.

16. The light module of claim 14, wherein the body is thermally conductive, wherein the body comprises a plurality of fins that extend from at least a top surface of the body, and wherein the top surface is disposed between the first end, the second end, the first side, and the second side.

17. A frame for a modular light fixture, the frame comprising:

a housing comprising at least one wall that forms a cavity, wherein the cavity is configured to receive at least one power source; and at least one first light module coupling device disposed on the at least one wall of the housing, wherein the at least one first light module coupling device comprises at least one first light module coupling feature and is configured to directly couple to a first frame coupling feature of at least one light module of the modular light fixture; and a connecting bracket comprising at least one second light module coupling device, wherein the at least one second light module coupling device comprises at least one second light module coupling feature and is configured to directly couple to a second frame coupling feature of the at least one light module of the modular light fixture, wherein the housing and the connecting bracket, without the at least one light module, are uncoupled from each other.

18. The frame of claim 17, wherein the housing is configured to receive at least one power source within the cavity, wherein the housing is further configured to allow power from the at least one power source to flow to the at least one light module.

19. The modular light fixture of claim 1, wherein the at least one first frame coupling feature of the first light module comprises a first lateral extension disposed within a first main section, wherein the first main section slidably receives a first stem of the at least one first light module coupling device of the housing, and wherein the first lateral extension slidably receives a first bottom portion of the at least one first light module coupling device of the housing.

20. The modular light fixture of claim 19, wherein the at least one second frame coupling feature of the first light module comprises a second lateral extension disposed within a second main section, wherein the second main section slidably receives a second stem of the at least one second light module coupling device of the connecting bracket, and wherein the second lateral extension slidably receives a second bottom portion of the at least one second light module coupling device of the connecting bracket.

* * * * *